US010801181B2

(12) United States Patent
Maekawa et al.

(10) Patent No.: US 10,801,181 B2
(45) Date of Patent: Oct. 13, 2020

(54) ENERGY REGENERATION DEVICE AND WORK MACHINE PROVIDED WITH ENERGY REGENERATION DEVICE

(71) Applicant: Kobe Steel, Ltd., Kobe-shi (JP)

(72) Inventors: Satoshi Maekawa, Kobe (JP); Naoki Sugano, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 16/348,021

(22) PCT Filed: Oct. 18, 2017

(86) PCT No.: PCT/JP2017/037632
§ 371 (c)(1),
(2) Date: May 7, 2019

(87) PCT Pub. No.: WO2018/088145
PCT Pub. Date: May 17, 2018

(65) Prior Publication Data

US 2019/0301140 A1 Oct. 3, 2019

(30) Foreign Application Priority Data

Nov. 9, 2016 (JP) ..... 2016-218687

(51) Int. Cl.
*F15B 21/14* (2006.01)
*E02F 9/22* (2006.01)
*F15B 11/044* (2006.01)

(52) U.S. Cl.
CPC ..... *E02F 9/2217* (2013.01); *E02F 9/22* (2013.01); *E02F 9/2221* (2013.01); (Continued)

(58) Field of Classification Search
CPC ..... E02F 9/2217; F15B 21/14; F15B 11/044
(Continued)

(56) References Cited

U.S. PATENT DOCUMENTS 8,567,185 B1 * 10/2013 Theobald ..... B25J 9/144 60/413
9,809,957 B2 * 11/2017 Rosth ..... E02F 9/2217
(Continued)

FOREIGN PATENT DOCUMENTS

JP 2014163419 A * 2/2013 ..... F15B 21/14
JP 2014-163419 A 9/2014

OTHER PUBLICATIONS

International Search Report dated Dec. 5, 2017 in PCT/JP2017/037632 filed Oct. 18, 2017.

*Primary Examiner* — Dustin T Nguyen
(74) *Attorney, Agent, or Firm* — Oblon, McClelland, Maier & Neustadt, L.L.P.

(57) ABSTRACT

An energy regeneration device capable of controlling flow of a working fluid discharged from an actuator while regenerating energy from the working fluid, and a work machine including the foregoing device, include a boom cylinder, an inertial fluid container, an oil tank, an accumulator, a low-pressure-side opening/closing device, and a high-pressure-side opening/closing device. A calculation unit calculates a duty ratio for opening/closing the low-pressure-side opening/closing device and the high-pressure-side opening/closing device in accordance with a desired flow rate of a hydraulic fluid discharged from the boom cylinder. A regeneration control unit selects alternately the low-pressure-side opening/closing device and the high-pressure-side opening/closing device as a destination with which the inertial fluid container communicates in accordance with the calculated duty ratio, and supplies the discharged hydraulic fluid to an accumulator.

8 Claims, 11 Drawing Sheets

(52) U.S. Cl.
CPC ..... *F15B 11/044* (2013.01); *F15B 21/14* (2013.01); *F15B 2211/255* (2013.01)

(58) Field of Classification Search
USPC ..... 60/414, 413, 418
See application file for complete search history.

(56) References Cited

U.S. PATENT DOCUMENTS

| | | | | |
|---|---|---|---|---|
| 10,174,770 | B2 * | 1/2019 | Zhang | F15B 1/024 |
| 10,358,797 | B2 * | 7/2019 | White | F15B 1/024 |
| 10,400,802 | B2 * | 9/2019 | Sugano | E02F 9/2289 |
| 2018/0251958 | A1 * | 9/2018 | Uemura | E02F 9/2016 |
| 2018/0306211 | A1 * | 10/2018 | Sipola | F15B 1/027 |
| 2019/0368514 | A1 * | 12/2019 | Maekawa | F15B 1/027 |

* cited by examiner

ENERGY REGENERATION DEVICE AND WORK MACHINE PROVIDED WITH ENERGY REGENERATION DEVICE

TECHNICAL FIELD

The present invention relates to an energy regeneration device which regenerates energy of a working fluid discharged from an actuator, and a work machine including the foregoing device.

BACKGROUND ART

Conventionally, as a means for regulating a flow rate of a hydraulic fluid in a hydraulic circuit of a work machine, a technique of controlling a flow rate of passage of a hydraulic fluid by a throttle effect of a valve, is known. Also, an energy regeneration apparatus in which pressure energy of a hydraulic fluid discharged from an actuator is recovered in an accumulator is known. Since a hydraulic fluid flows from a high-pressure side to a low-pressure side, it is difficult to recover a hydraulic fluid on an accumulator side in a case where a pressure of the accumulator is equal to or higher than a pressure on an actuator side. Accordingly, a pressure of an accumulator should be set to be lower than a pressure on an actuator side in order to stably recover a hydraulic fluid in the accumulator. Further, in order to reduce a range of variation in an internal pressure of an accumulator, it is necessary to increase a capacity of the accumulator. Thus, an accumulator is increased in a size, which invites a problem of increase in a size and a cost of an apparatus.

Meanwhile, Patent Literature 1 discloses a technique in which an inertial fluid container which can communicate with a discharge side of an actuator, a high-pressure-side container, and a low-pressure-side container are included, and the inertial fluid container is caused to communicate with the high-pressure-side container and the low-pressure-side container alternately, so that energy of a working fluid is recovered in the high-pressure-side container with the use of inertia of a fluid.

In the foregoing energy regeneration apparatus, when a high-pressure-side opening/closing device is closed and a low-pressure-side opening/closing device is opened, a working fluid flows into the low-pressure-side container from the inertial fluid container. At that time, because of flow of a working fluid, an inertial force of fluid is generated in the inertial fluid container. Thereafter, when the low-pressure-side opening/closing device is closed and the high-pressure-side opening/closing device is opened, a working fluid flows into the high-pressure-side opening/closing device due to the inertial force of fluid generated in the inertial fluid container. As a result, a pressure of a working fluid can be accumulated in the high-pressure-side opening/closing device.

CITATION LIST

Patent Literature

Patent Literature 1: JP 2014-163419 A

In a work machine used in a construction site or the like, an operation speed of a hydraulically-driven actuator is controlled in accordance with an amount of an operation performed on an operation lever by an operator. In the technique described in Patent Literature 1, in regenerating energy of a working fluid, it is impossible to control an operation speed of a hydraulically-driven actuator such that it becomes equal to a desired speed. Accordingly, there is caused a problem of non-correspondence between an operation amount of the operation lever and an operation speed of a hydraulically-driven actuator.

SUMMARY OF INVENTION

It is an object of the present invention to provide an energy regeneration device which can regenerate energy of a working fluid discharged from an actuator while controlling a flow rate of the working fluid, and a work machine including the foregoing device.

Provided is an energy regeneration device for regenerating energy of a working fluid, including: an actuator including a cylinder and a piston that is reciprocatable in the cylinder, the actuator being configured such that a volume of a cylinder fluid chamber defined by the cylinder and the piston varies along with movement of the piston; an inertial fluid container including a first internal space that is configured to communicate with the cylinder fluid chamber, the inertial fluid container being configured to receive the working fluid that is discharged from the cylinder fluid chamber due to the movement of the piston; a low-pressure-side container including a second internal space that is set at a pressure lower than that of the cylinder fluid chamber and is configured to communicate with the first internal space of the inertial fluid container, the low-pressure-side container being configured to receive the working fluid flowing out of the inertial fluid container; a high-pressure-side container including a third internal space that is set at a pressure higher than that of the second internal space of the low-pressure-side container and is configured to communicate with the first internal space of the inertial fluid container, the high-pressure-side container being configured to receive the working fluid flowing out of the inertial fluid container; a low-pressure-side opening/closing device forming a low-pressure-side opening that is configured to permit flowing of the working fluid between the inertial fluid container and the low-pressure-side container, the low-pressure-side opening/closing device being configured to operate to change an opening area of the low-pressure-side opening; a high-pressure-side opening/closing device forming a high-pressure-side opening that is configured to permit flowing of the working fluid between the high-pressure-side container and the inertial fluid container, the high-pressure-side opening/closing device being configured to operate to change an opening area of the high-pressure-side opening; a first pressure obtaining unit configured to obtain a discharge pressure of the working fluid upstream of the inertial fluid container in flow of the working fluid flowing out of the cylinder fluid chamber; a second pressure obtaining unit configured to obtain a high-pressure-side pressure of the working fluid downstream of the high-pressure-side opening/closing device in the flow of the working fluid flowing out of the cylinder fluid chamber; an opening-area determination unit configured to determine the opening area of each of the high-pressure-side opening and the low-pressure-side opening in accordance with operational conditions of the actuator; a calculation unit configured to calculate a duty ratio for controlling an open time of each of the low-pressure-side opening and the high-pressure-side opening in a predetermined period for a case where the piston moves at a predetermined moving speed in such a direction as to reduce the volume of the cylinder fluid chamber, the calculation unit being configured to calculate the duty ratio based on the opening area of each of the high-pressure-side opening and the low-pressure-side opening, the opening area being determined by the opening-area determination unit, a desired flow rate of the working fluid discharged from the cylinder fluid chamber, the desired flow rate being set in accordance with the moving speed of the piston, the discharge pressure obtained by the first pressure obtaining unit, and the high-pressure-side pressure obtained by the second pressure obtaining unit; and an opening/closing-device control unit configured to control an opening/closing operation of the high-pressure-side opening/closing device and the low-pressure-side opening/closing device in accordance with the duty ratio such that the low-pressure-side container and the high-pressure-side container are alternately selected as a destination with which the inertial fluid container communicates, to cause the working fluid to flow into the high-pressure-side container due to an inertial force that is generated in the first internal space of the inertial fluid container when the working fluid flows toward the low-pressure-side container, while causing the piston to move at the moving speed.

Also provided is a work machine including: an engine; the above-described energy regeneration device; a driven object connected to the piston of the actuator of the energy regeneration device; a pump being configured to be driven by the engine and discharge the working fluid supplied to the cylinder fluid chamber of the actuator; a control valve placed between the pump and the actuator on a path of the working fluid, the control valve being configured to control a flow rate of the working fluid supplied to the cylinder fluid chamber, to drive the actuator; an operation lever configured to receive an operation for an instruction to drive the driven object; and a drive control unit configured to control movement of the actuator by operating the control valve in accordance with an amount of an operation performed on the operation lever, wherein the desired flow rate of the working fluid discharged from the cylinder fluid chamber is set in accordance with the amount of the operation performed on the operation lever.

DESCRIPTION OF EMBODIMENTS

Figure 1:
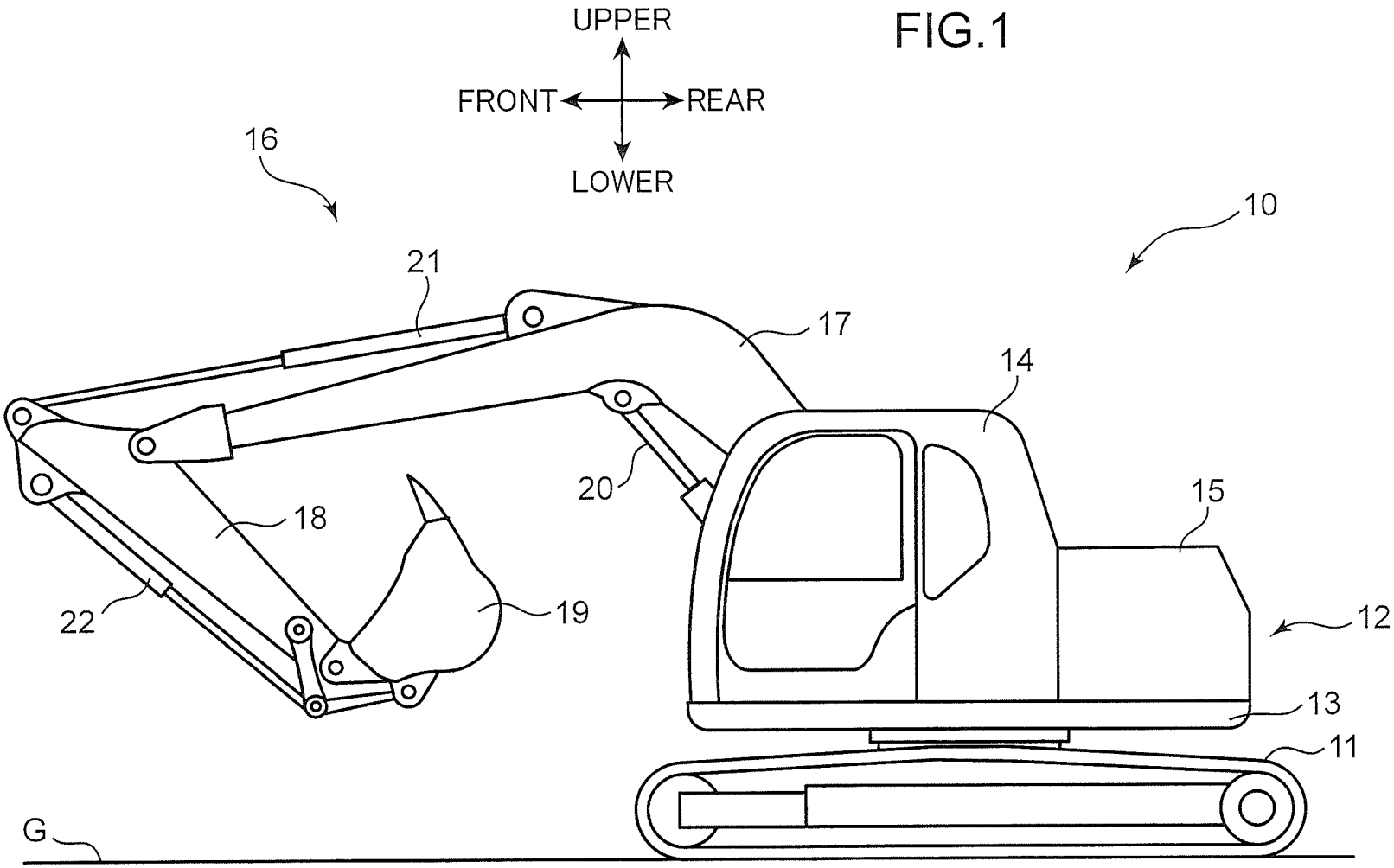
FIG. 1 is a schematic side view of a work machine according to one embodiment of the present invention.

Hereinafter, with reference to the drawings, each of embodiments of the present invention will be described. FIG. 1 is a side view of a hydraulic excavator 10 (work machine) according to one embodiment of the present invention. It is noted that directions such as "upper", "lower, "front" and "rear", which are shown in FIG. 1, are shown for the sake of convenience in explaining a configuration of the hydraulic excavator 10 according to the present embodiment, and do not limit a use form or the like of a work machine according to the present invention.

The hydraulic excavator 10 includes a lower traveling body 11 and an upper slewing body 12 which is supported on the lower traveling body 11 in such a manner that the upper slewing body 12 can slew around a vertical axis. The lower traveling body 11 and the upper slewing body 12 form a base of the hydraulic excavator 10. The upper slewing body 12 includes an upper frame 13, and also includes a cab 14 and a counter weight 15 which are provided on the upper frame 13. The upper frame 13 is formed of a plate-shaped member which extends horizontally. The cab 14 is equipped with an operation unit (an operation lever 107) or the like which is operated by an operator of the hydraulic excavator 10. The counter weight 15 is provided in a rear portion of the upper frame 13, and has a function of keeping balance of the hydraulic excavator 10.

Further, in a front portion of the upper frame 13, a working attachment 16 is mounted. The working attachment 16 is supported on the upper frame 13 by a supporting mechanism not shown in the drawings. The working attachment 16 includes a boom 17 which is mounted in the upper slewing body 12 in such a manner that the boom 17 can rise and fall, an arm 18 which is turnably connected to a distal end of the boom 17, and a bucket 19 which is turnably connected to a distal end of the arm 18.

In the working attachment 16, a boom cylinder 20 which is a hydraulic actuator for a boom, an arm cylinder 21 which is a hydraulic actuator for an arm, and a bucket cylinder 22 which is a hydraulic actuator for a bucket are mounted, and those cylinders include hydraulic cylinders which can telescope. The boom cylinder 20 is interposed between the boom 17 and the upper slewing body 12 so that the boom cylinder 20 telescopes in response to receive a hydraulic fluid and causes the boom 17 to turn in a direction in which the boom 17 rises and falls. The arm cylinder 21 is interposed between the arm 18 and the boom 17 so that the arm cylinder 21 telescopes in response to receive a hydraulic fluid and causes the arm 18 to turn about a horizontal axis with respect to the boom 17. Further, the bucket cylinder 22 is interposed between the bucket 19 and the arm 18 so that the bucket cylinder 22 telescopes in response to receive a hydraulic fluid and causes the bucket 19 to turn about a horizontal axis with respect to the arm 18.

It should be noted that a work machine to which the present invention is applied is not limited to the hydraulic excavator 10. The present invention is widely applicable to work machines each including a driven object which is driven by a fluid pressure such as a hydraulic pressure. It is also noted that a crusher, a disassembling machine, and the like in addition to a bucket can be employed as a working attachment.

Figure 2:
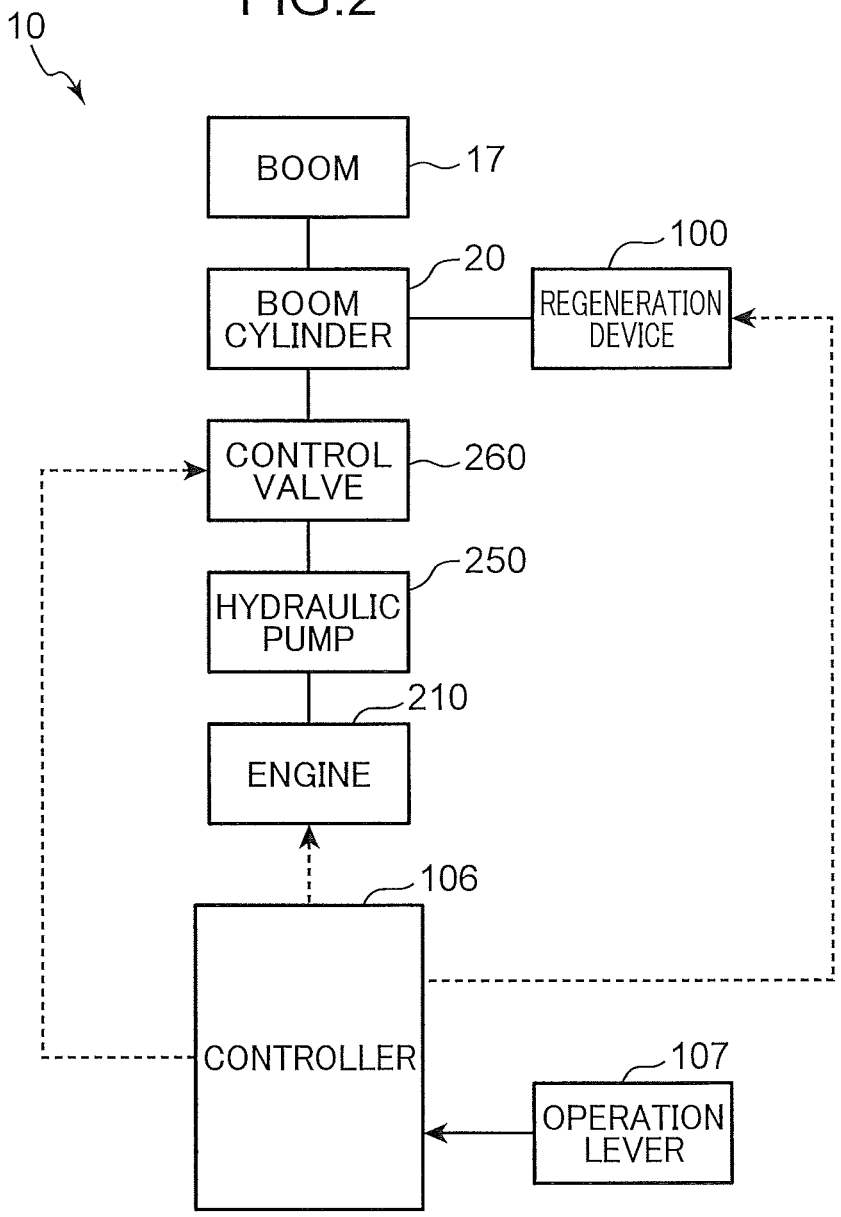
FIG. 2 is a block diagram showing one example of a system configuration of the work machine shown in FIG. 1.

FIG. 2 is a block diagram showing an example of a system configuration of the hydraulic excavator 10 shown in FIG. 1. The hydraulic excavator 10 includes an engine 210, a hydraulic pump 250 (pump) connected to an output shaft of the engine 210, a control valve 260 (control valve) which controls charge/discharge of a hydraulic fluid from the hydraulic pump 250 to the boom cylinder 20, a controller 106, and an operation lever 107.

The hydraulic pump 250 operates under power of the engine 210, and discharges a hydraulic fluid. A hydraulic fluid discharged from the hydraulic pump 250 is supplied to a head-side hydraulic chamber 203 (FIG. 3) or a rod-side hydraulic chamber 204, which will be later described, in the boom cylinder 20, with a flow rate thereof being controlled by the control valve 260. As a result, the boom 17 connected to a piston rod 202A (FIG. 3) of the boom cylinder 20 is driven.

The control valve 260 is placed between the hydraulic pump 250 and the boom cylinder 20 on a path of a hydraulic fluid. The control valve 260 controls a flow rate of a hydraulic fluid which is supplied to the head-side hydraulic chamber 203 or the rod-side hydraulic chamber 204 of the boom cylinder 20, to drive the boom cylinder 20. The control valve 260 is electrically controlled by the controller 106, and includes a pilot-operated hydraulic selector valve and a proportional solenoid valve. The hydraulic selector valve includes a pilot port not shown in the drawings. The hydraulic selector valve operates to open a valve in accordance with a pilot pressure input to the pilot port, and changes a flow rate of a hydraulic fluid supplied to the boom cylinder 20. Also, the hydraulic selector valve switches a destination of supply of a hydraulic fluid between the head-side hydraulic chamber 203 (FIG. 3) and the rod-side hydraulic chamber 204 of the boom cylinder 20. The proportional solenoid valve regulates a flow rate of oil for a pilot, the oil flowing into the hydraulic selector valve, in accordance with a control signal provided from the controller 106, in order to change a pilot pressure input to the hydraulic selector valve.

The controller 106 outputs a control signal for setting an opening degree of the proportional solenoid valve of the above-described control valve 260 in accordance with an operation amount of the operation lever 107. The operation lever 107 is installed inside the cab 14 and is operated by an operator. The operation lever 107 receives an operation for an instruction to drive the working attachment 16 including the boom 17. In the present embodiment, a plurality of operation levers 107 are provided for respective operations of the boom 17, the arm 18, and the bucket 19 and a slewing operation of the upper slewing body 12. It is noted that the operation lever 107 may be designed so as to be operable in a plurality of directions so that the operations of the above-described plurality of members can be assigned to a common operation lever 107.

The boom cylinder 20 telescopes in response to supply of a hydraulic fluid. It is noted that though FIG. 2 shows that the control valve 260 is placed between the boom cylinder 20 and the hydraulic pump 250, the control valve 260 configured similarly is placed also between each of the arm cylinder 21 and the bucket cylinder 22 in FIG. 1, and the hydraulic pump 250. Each cylinder is configured so as to be independently controllable in response to a control signal of the controller 106.

Figure 3:
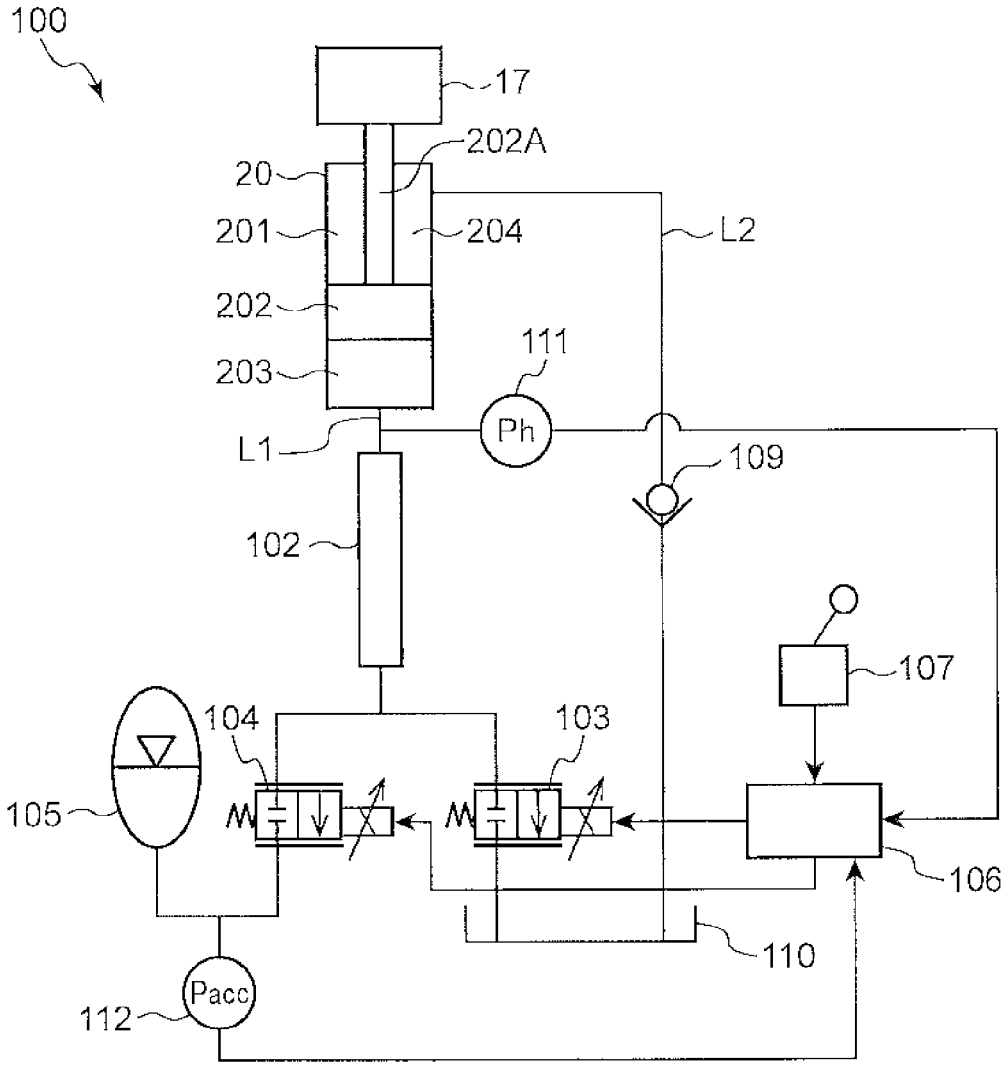
FIG. 3 is a hydraulic circuit diagram of an energy regeneration device included in the work machine according to the one embodiment of the present invention.
Figure 4:
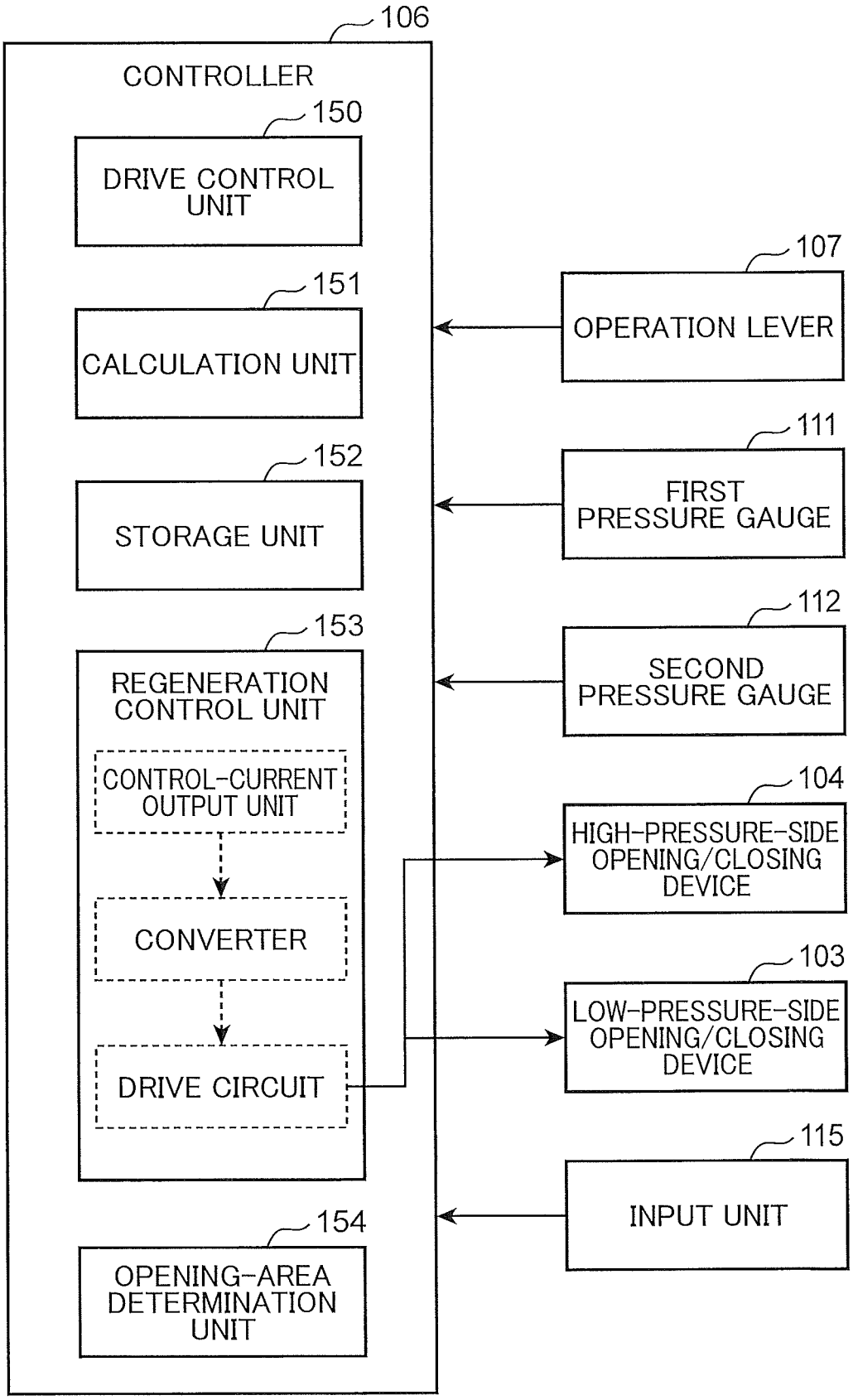
FIG. 4 is a block diagram of a controller of the work machine according to the one embodiment of the present invention.

Further, as shown in FIG. 2, the hydraulic excavator 10 includes a regeneration device 100 (energy regeneration device). The regeneration device 100 has a function of regenerating energy of a hydraulic fluid discharged from the boom cylinder 20. FIG. 3 is a hydraulic circuit diagram of the regeneration device 100. FIG. 4 is a block diagram of the controller 106.

The regeneration device 100 includes an inertial fluid container 102, a low-pressure-side opening/closing device 103, a high-pressure-side opening/closing device 104, an accumulator 105 (high-pressure-side container), a check valve 109, an oil tank 110 (low-pressure-side container), a first pressure gauge 111 (first pressure obtaining unit), and a second pressure gauge 112 (second pressure obtaining unit), in addition to the boom cylinder 20 (actuator) and the controller 106 which have already been mentioned.

The aforementioned boom cylinder 20 includes a cylinder 201, a piston 202, and a piston rod 202A. The piston 202 is configured so as to be reciprocatable in the cylinder 201. The cylinder 201 and the piston 202 define the head-side hydraulic chamber 203 (cylinder fluid chamber) and the rod-side hydraulic chamber 204. One side surface of the piston 202 is connected to the piston rod 202A. A distal end of the piston rod 202A is connected to the aforementioned boom 17 (driven object) which serves as a working load of the boom cylinder 20.

The head-side hydraulic chamber 203 is formed in the cylinder 201, and is sealed with a hydraulic fluid (working fluid) being charged therein. A volume of the head-side hydraulic chamber 203 varies along with reciprocation of the piston 202. Likewise, the rod-side hydraulic chamber 204 is formed in the cylinder 201 and is sealed with a hydraulic fluid being charged therein. A volume of the rod-side hydraulic chamber 204 can vary along with reciprocation of the piston 202. More specifically, in FIG. 3, when the piston 202 moves upward, a volume of the head-side hydraulic chamber 203 is increased and a volume of the rod-side hydraulic chamber 204 is reduced. On the other hand, when the piston 202 moves downward, a volume of the head-side hydraulic chamber 203 is reduced and a volume of the rod-side hydraulic chamber 204 is increased.

The inertial fluid container 102 includes an internal space (first internal space) which communicates with the head-side hydraulic chamber 203 of the boom cylinder 20. The inertial fluid container 102 receives a hydraulic fluid which is discharged from the head-side hydraulic chamber 203 due to movement of the piston 202. In the present embodiment, the inertial fluid container 102 includes a pipe having a predetermined inside diameter.

The oil tank 110 includes an internal space (second internal space) which is set at a pressure lower than that of the head-side hydraulic chamber 203 of the boom cylinder 20. The internal space of the oil tank 110 can communicate with the internal space of the inertial fluid container 102. The oil tank 110 receives a hydraulic fluid which flows out of the inertial fluid container 102. The accumulator 105 includes an internal space (third internal space) which is set at a pressure higher than that of the internal space of the oil tank 110. The internal space of the accumulator 105 can communicate with the internal space of the inertial fluid container 102. The accumulator 105 receives a hydraulic fluid which flows out of the inertial fluid container 102. At that time, the accumulator 105 accumulates a pressure of a hydraulic fluid.

The low-pressure-side opening/closing device 103 is an opening/closing valve (metering valve) which is placed between the inertial fluid container 102 and the oil tank 110. More specifically, the low-pressure-side opening/closing device 103 includes a valve structure with a metering function in which an opening degree continuously varies in accordance with a stroke of a valve body. The low-pressure-side opening/closing device 103 forms a not-shown opening (low-pressure-side opening) which permits flowing of a hydraulic fluid between the inertial fluid container 102 and the oil tank 110, and allows the inertial fluid container 102 and the oil tank 110 to communicate with each other or interrupts communication therebetween. Further, the low-pressure-side opening/closing device 103 operates to change an opening area of the above-described opening.

Likewise, the high-pressure-side opening/closing device 104 is an opening/closing valve (metering valve) which is placed between the inertial fluid container 102 and the accumulator 105. The high-pressure-side opening/closing device 104 also includes a valve structure with a metering function in which an opening degree continuously varies in accordance with a stroke of a valve body. The high-pressure-side opening/closing device 104 forms a not-shown opening (high-pressure-side opening) which permits flowing of a hydraulic fluid between the inertial fluid container 102 and the accumulator 105, and allows the inertial fluid container 102 and the accumulator 105 to communicate with each other or interrupts communication therebetween. Further, the high-pressure-side opening/closing device 104 operates to change an opening area of the above-described opening. It is noted that an opening area of each of the low-pressure-side opening of the low-pressure-side opening/closing device 103 and the high-pressure-side opening of the high-pressure-side opening/closing device 104 is previously set to a predetermined opening area A1, and is adjusted when necessary as described later.

The first pressure gauge 111 detects (obtains) a discharge pressure Ph of a hydraulic fluid located on a side closer to the head-side hydraulic chamber 203 of the boom cylinder 20 with respect to the inertial fluid container 102. In other words, the first pressure gauge 111 detects the discharge pressure Ph of a hydraulic fluid located upstream of the inertial fluid container 102 in flow of a hydraulic fluid flowing out of the head-side hydraulic chamber 203. Also, the second pressure gauge 112 detects (obtains) a high-pressure-side pressure Pacc (accumulator pressure) of a hydraulic fluid located on a side closer to the accumulator 105 with respect to the high-pressure-side opening/closing device 104. In other words, the second pressure gauge 112 detects the high-pressure-side pressure Pacc of a hydraulic fluid located downstream of the high-pressure-side opening/closing device 104 in flow of a hydraulic fluid flowing out of the head-side hydraulic chamber 203.

Additionally, in the hydraulic excavator 10, a head-side oil path L1 and a rod-side oil path L2 are provided. Along the head-side oil path L1, a hydraulic fluid passes from the head-side hydraulic chamber 203 of the boom cylinder 20 to the low-pressure-side opening/closing device 103 or the accumulator 105 through the inertial fluid container 102. Along the rod-side oil path L2, a hydraulic fluid passes from the rod-side hydraulic chamber 204 to the oil tank 110. The check valve 109 has a function of making up for a shortage of a flow rate for the rod-side hydraulic chamber 204 of the boom cylinder 20 with the oil tank 110 (anti-cavitation checking function) at the time of an operation of lowering a boom.

Further, the hydraulic excavator 10 includes an input unit 115 (FIG. 4). The input unit 115 is installed in the cab 14 and includes an operation panel and a display unit which are not shown in the drawings. The input unit 115 receives an instruction for control of operations of the hydraulic excavator 10.

With reference to FIG. 4, the controller 106 is configured to control the hydraulic excavator 10 in a centralized manner, and is electrically connected to the operation lever 107, the first pressure gauge 111, the second pressure gauge 112, the low-pressure-side opening/closing device 103, the high-pressure-side opening/closing device 104, the input unit 115, and the like, as a transmitter or receiver of a control signal. The controller 106 includes a central processing unit (CPU), a read only memory (ROM) in which a control program is stored, a random access memory (RAM) which is used as a workspace of the CPU, and the like, and operates by execution of the control program in the CPU in such a manner that the controller 106 functionally includes a drive control unit 150, a calculation unit 151, a storage unit 152, a regeneration control unit 153 (opening/closing-device control unit), and an opening-area determination unit 154.

The drive control unit 150 controls movement of the boom cylinder 20 by operating the control valve 260 in accordance with an amount of an operation performed on the operation lever 107. Also, in the present embodiment, the drive control unit 150 executes a control mode which will be described later.

The calculation unit 151 calculates a duty ratio d1 for controlling an opening/closing operation of the low-pressure-side opening/closing device 103 and the high-pressure-side opening/closing device 104 for a case where the piston 202 moves in such a direction as to reduce a volume of the head-side hydraulic chamber 203 of the boom cylinder 20. The duty ratio d1 is set in accordance with a desired flow rate Q1 of a hydraulic fluid discharged from the head-side hydraulic chamber 203 of the boom cylinder 20.

In the storage unit 152, information about the desired flow rate Q1 of a hydraulic fluid in accordance with an amount of operation of the operation lever 107 is stored. Also, in the storage unit 152, a duty-ratio threshold value de (threshold value) which is previously set is stored, in order to suppress backflow of a hydraulic fluid from the accumulator 105 toward the inertial fluid container 102. Those pieces of information are output from the storage unit 152 as needed.

The regeneration control unit 153 controls an opening/closing operation of the low-pressure-side opening/closing device 103 and the high-pressure-side opening/closing device 104 based on the above-described duty ratio d1 in such a manner that the oil tank 110 and the accumulator 105 are alternately selected as a destination with which the inertial fluid container 102 communicates.

The opening-area determination unit 154 determines an opening area A of an opening of each of the low-pressure-side opening/closing device 103 and the high-pressure-side opening/closing device 104 in accordance with operational conditions of the hydraulic excavator 10 including the boom cylinder 20.

Figure 5:
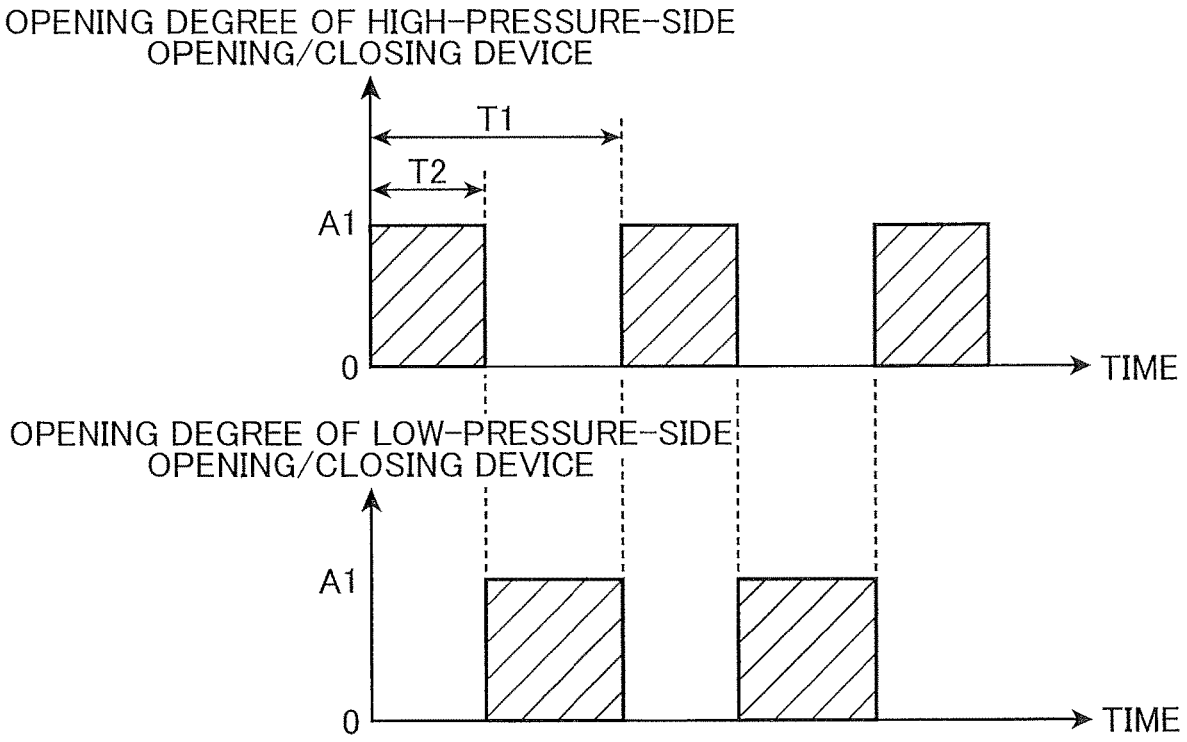
FIG. 5 includes graphs showing relationships each between an open time and an opening degree of opening/closing devices included in the energy regeneration device according to the one embodiment of the present invention.
Figure 6:
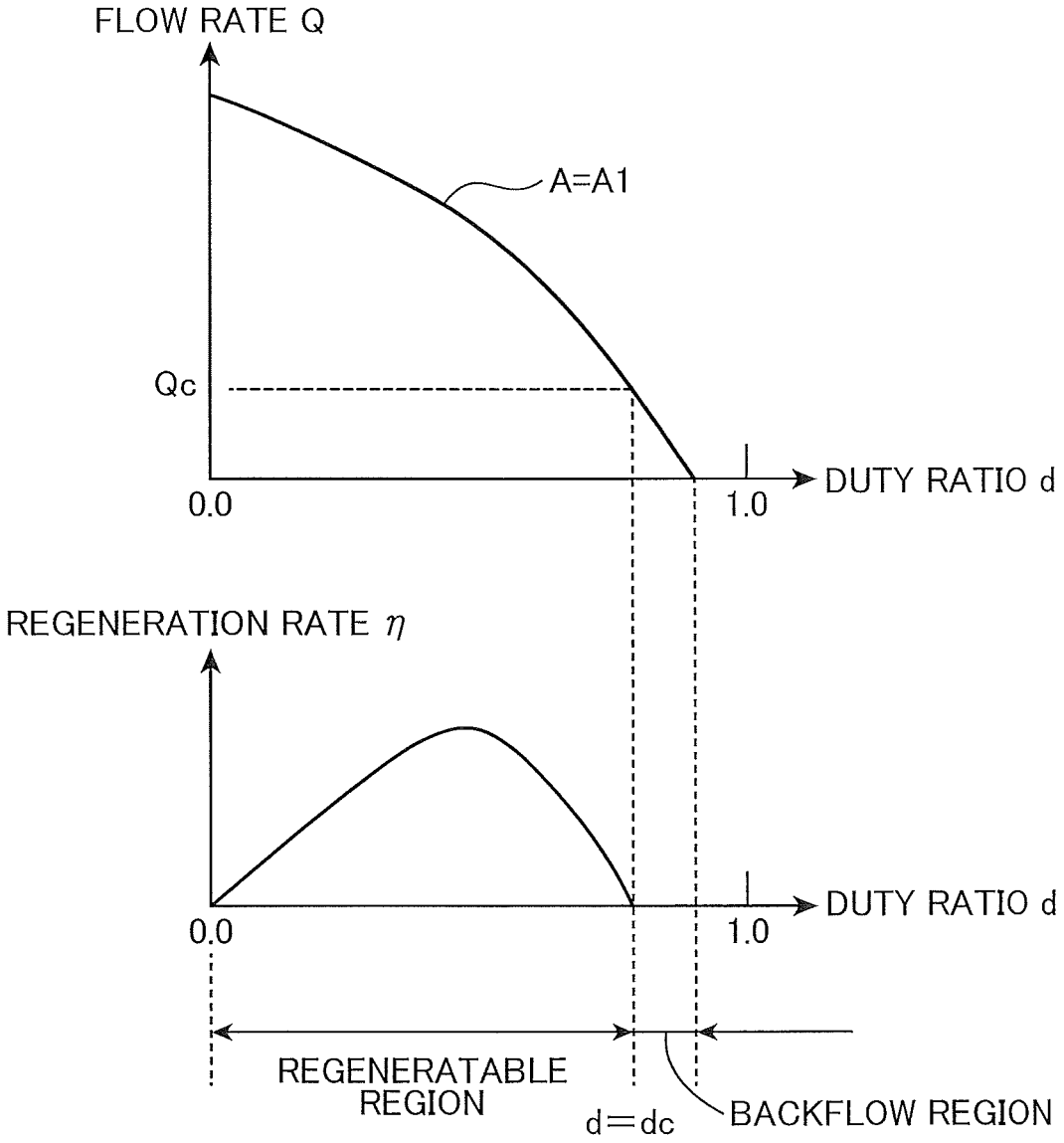
FIG. 6 includes graphs showing relationships between a duty ratio for controlling an opening area of each opening/closing device included in the energy regeneration device according to the one embodiment of the present invention, and each of a flow rate of a working fluid and an energy regeneration rate.

Next, with reference to FIGS. 5 and 6, together with FIGS. 2 to 4, an energy regenerating process in the regeneration device 100 will be described. FIG. 5 includes graphs showing relationships each between an open time and an opening degree of the low-pressure-side opening/closing device 103 and the high-pressure-side opening/closing device 104 which are included in the regeneration device 100. FIG. 6 includes graphs showing relationships between a duty ratio for controlling an opening area of each of the low-pressure-side opening/closing device 103 and the high-pressure-side opening/closing device 104 which are included in the regeneration device 100 according to the present embodiment, and each of a flow rate of a hydraulic fluid and an energy regeneration rate.

In the regeneration device 100, when the controller 106 closes an opening of the high-pressure-side opening/closing device 104 and opens an opening of the low-pressure-side opening/closing device 103, a hydraulic fluid in the inertial fluid container 102 flows into the oil tank 110. At that time, because of flow of a hydraulic fluid, an inertial force of fluid is generated in the internal space of the inertial fluid container 102. Subsequently, when the controller 106 closes an opening of the low-pressure-side opening/closing device 103 and opens an opening of the high-pressure-side opening/closing device 104, a hydraulic fluid can flow into, and be accumulated in, the accumulator 105 because of an inertial force of fluid generated in the inertial fluid container 102 in the above-described manner. Additionally, even if a pressure of the accumulator 105 is equal to or higher than a pressure of the inertial fluid container 102, a hydraulic fluid can flow into, and be accumulated in, the accumulator 105 as long as an inertial force of fluid is maintained in the inertial fluid container 102.

It is noted that an inertial force of fluid in the inertial fluid container 102 is reduced with time. Hence, the controller 106 again closes the high-pressure-side opening/closing device 104 and opens the low-pressure-side opening/closing device 103, to thereby restore an inertial force of fluid. For this reason, the controller 106 alternates an opening/closing period of the low-pressure-side opening/closing device 103 with an opening/closing period of the high-pressure-side opening/closing device 104 in a regular period. With this configuration, it is possible to regenerate energy and accumulate it in the accumulator 105 even if a pressure of the accumulator 105 is equal to or higher than a pressure of the head-side hydraulic chamber 203 of the boom cylinder 20.

With reference to FIG. 5, in performing operations for energy regeneration, the controller 106 alternates an operation of opening and shutting down (an opening/closing operation) the low-pressure-side opening/closing device 103, with an opening/closing operation of the high-pressure-side opening/closing device 104 at a high speed. More specifically, as shown in FIG. 4, the regeneration control unit 153 of the controller 106 includes a control-current output unit, a converter (PWM converter), and a driving circuit. The control-current output unit outputs a pulse signal for controlling an opening/closing operation of the low-pressure-side opening/closing device 103 and the high-pressure-side opening/closing device 104. In this regard, the pulse signal is formed of a predetermined rectangular wave, and an opening/closing time of each of the low-pressure-side opening/closing device 103 and the high-pressure-side opening/closing device 104 is controlled by a duty ratio d of the pulse signal. With reference to FIG. 5, the duty ratio d is defined by the following formula 1. In the formula, T1 represents a time of one cycle (period) in which each of the low-pressure-side opening/closing device 103 and the high-pressure-side opening/closing device 104 is opened and then closed, and T2 represents a time in which the high-pressure-side opening/closing device 104 is opened in one cycle. That is, the duty ratio d defined by the formula 1 corresponds to a duty ratio d1 for a high-pressure side for controlling an open time of the high-pressure-side opening 104 in the period T1. Also, in one example, a frequency of a pulse signal for controlling an opening/closing operation of the low-pressure-side opening/closing device 103 and the high-pressure-side opening/closing device 104 is set to 100 Hz.

[Formula 1]

$$d = \frac{T2}{T1} \tag{1}$$

It is noted that a time in which the low-pressure-side opening/closing device 103 is opened is equal to T1-T2. Accordingly, a low-pressure-side duty ratio for controlling an open time of the low-pressure-side opening 103 in the period T1 is equal to 1−d1. In this manner, a destination of flow of a hydraulic fluid is switched between the accumulator 105 and the oil tank 110 at a high speed, so that flow of a hydraulic fluid discharged from the boom cylinder 20 can be stably maintained.

It is noted that in a stage of design of the regeneration device 100, a maximum opening area Amax of each of the low-pressure-side opening/closing device 103 and the high-pressure-side opening/closing device 104 is set. The maximum opening area Amax of each of the low-pressure-side opening/closing device 103 and the high-pressure-side opening/closing device 104 is designed by a formula 2 in which Qmax represents a maximum flow rate of a hydraulic fluid discharged from the boom cylinder 20.

[Formula 2]

$$Amax > \frac{Qmax}{Cv \times \sqrt{(Ph0)}} \tag{2}$$

Ph represents a discharge pressure of a hydraulic fluid, the discharge pressure being measurable by the first pressure gauge 111 (FIG. 3), and Ph0 in the formula 2 is a discharge-pressure design value for determining A1 in a stage of design. It is noted that when the hydraulic excavator 10 is actually operated, the discharge pressure Ph varies depending on an inertial force at an accelerating/decelerating time of the boom 17, or on presence or absence of a load on the boom 17. Accordingly, in a stage of design of the regeneration device 100, the discharge-pressure design value Ph0 is calculated by the following formula 3 in which M represents a mass of the boom 17 corresponding to a reference load on the boom cylinder 20 and Ah represents a head-side area of the boom cylinder 20. It is noted that g in the formula 3 represents gravitational acceleration.

[Formula 3]

$$Ph0 = \frac{M \times g}{Ah} \tag{3}$$

FIG. 6 shows a flow rate Q of a hydraulic fluid and a regeneration rate η (efficiency of regeneration) in a case where the duty ratio d of a pulse signal for controlling the low-pressure-side opening/closing device 103 and the high-pressure-side opening/closing device 104 is changed. In graphs of FIG. 6, an area of an opening of each of the low-pressure-side opening/closing device 103 and the high-pressure-side opening/closing device 104 is set to A1. It is noted that the regeneration rate η indicates a rate at which energy of a hydraulic fluid discharged from the boom cylinder 20 is recovered in the accumulator 105, and is defined by the following formula 4.

[Formula 4]

$$\eta = \frac{Qacc \times Pacc}{Qh \times Ph} \quad (4)$$

In the formula 4, Qacc represents a flow rate of a hydraulic fluid which flows into the accumulator 105, and Qh represents a flow rate of a hydraulic fluid which flows out of the head-side hydraulic chamber 203 of the boom cylinder 20. Pacc represents an accumulator pressure which is measured by the second pressure gauge 112, and Ph represents a discharge pressure of a hydraulic fluid, the discharge pressure being measured by the first pressure gauge 111.

With reference to FIG. 6, a flow rate of a hydraulic fluid decreases as the duty ratio d becomes closer to 1.0, and a flow rate of a hydraulic fluid increases as the duty ratio d becomes closer to zero. Accordingly, it is preferable to bring the duty ratio d closer to zero in order to maintain a high flow rate of a hydraulic fluid. However, the regeneration rate η is reduced as the duty ratio d becomes closer to zero, as shown in FIG. 6. This is because a condition for making the duty ratio d equal to zero is a state in which the low-pressure-side opening/closing device 103 is always opened and the high-pressure-side opening/closing device 104 is always closed. Thus, a desired value of the duty ratio d is between zero and one in order to encourage compatibility between a flow rate of a hydraulic fluid and the regeneration rate η, and it is preferable that the desired duty ratio d is set to a region close to a medium (0.5), especially, a range of $0.3 \leq d \leq 0.7$.

Figure 7:
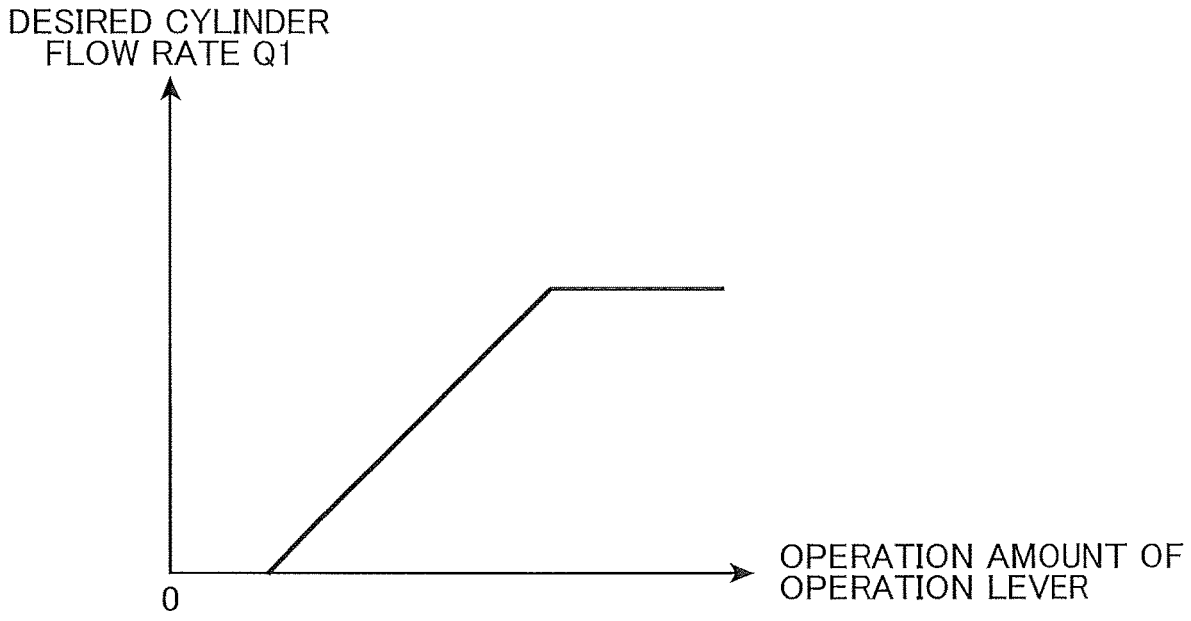
FIG. 7 is a graph showing a relationship between an amount of operation of an operation lever of the work machine according to the one embodiment of the present invention, and a desired flow rate of a working fluid.

Next, operations for a regenerating process performed by the controller 106 when the hydraulic excavator 10 is operated will be described. FIG. 7 is a graph showing a relationship between an amount of operation of the operation lever 107 and a desired cylinder flow rate Q1 in the hydraulic excavator 10 according to the present embodiment. Data corresponding to the graph in FIG. 7 is stored in the storage unit 152 (FIG. 4) of the controller 106. The desired cylinder flow rate Q1 is equal to a flow rate of a hydraulic fluid which is discharged from the boom cylinder 20 so that the piston 202 can move at a predetermined speed in accordance with an amount of operation of the operation lever 107.

In order for an operator of the hydraulic excavator 10 to operate the boom 17, a moving speed of the boom 17 is set in accordance with an amount of operation of the operation lever 107. A moving speed of the piston 202 of the boom cylinder 20 is set to be equal to a required moving speed of the boom 17, so that high operability for an operator is maintained. In the present embodiment, with a moving speed (a flow rate of discharged hydraulic fluid) of the boom 17 (the piston 202) being made controllable, the controller 106 performs operations for the regenerating process in order to recover energy of discharged hydraulic fluid in the accumulator 105.

Figure 8A:
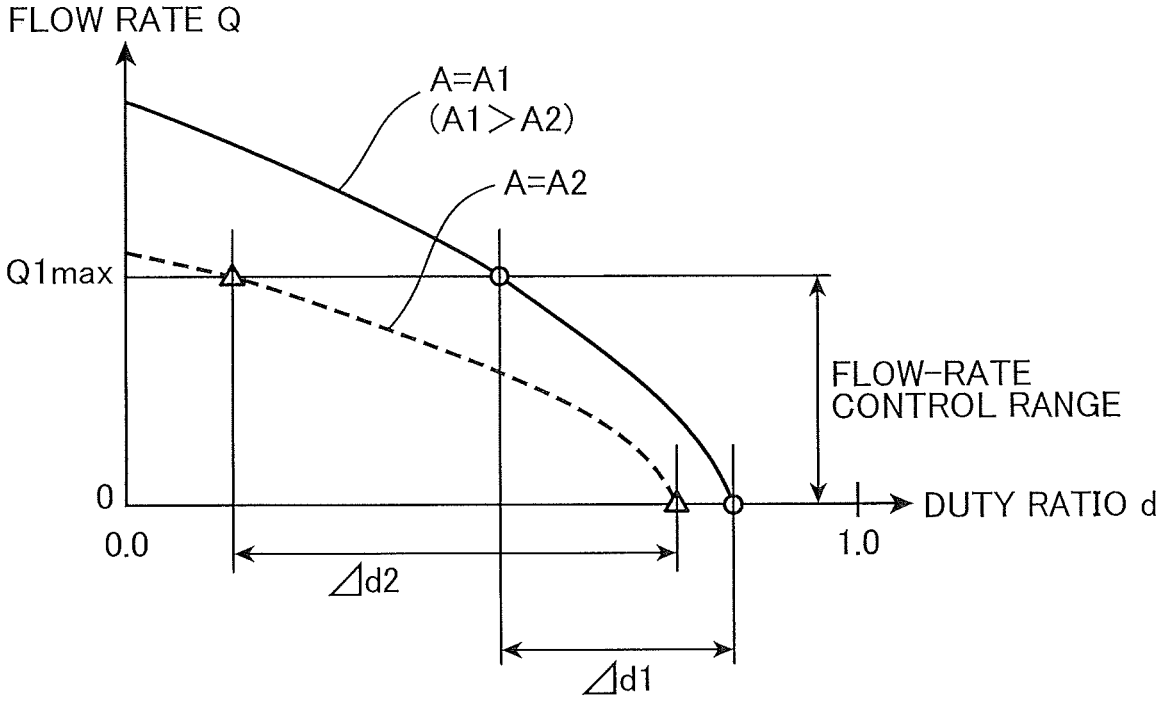
FIG. 8A includes graphs showing relationships between a duty ratio for controlling an opening area of an opening/closing device and a flow rate of a working fluid in the energy regeneration device according to the one embodiment of the present invention.
Figure 8B:
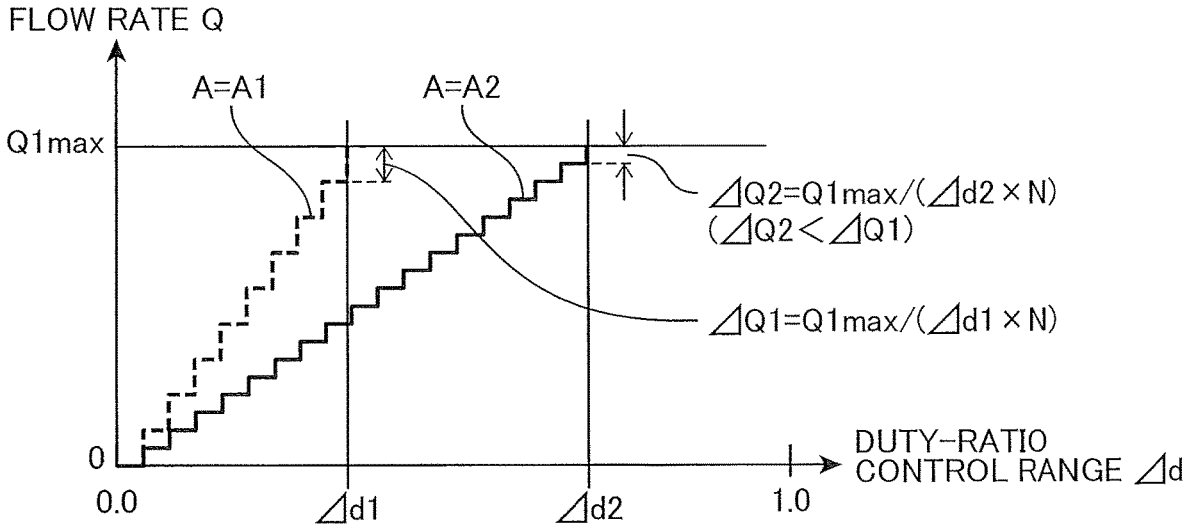
FIG. 8B includes graphs showing relationships between a duty-ratio control range and a flow rate of a working fluid in the energy regeneration device according to the one embodiment of the present invention.

FIG. 8A includes graphs showing relationships between the duty ratio d for controlling an opening area of each opening/closing device and a flow rate Q of a hydraulic fluid, and FIG. 8B includes graphs showing relationships between a control range Δd of the foregoing duty ratio and the flow rate Q of a hydraulic fluid, in the regeneration device 100 according to the present embodiment.

In the present embodiment, the drive control unit 150 which controls movement of the working attachment 16 has a control mode which becomes active at the time of normal operation of the hydraulic excavator 10. When an operator operates the boom 17 in a normal manner with the operation lever 107, the operator operates the lever extensively in some cases, to drive the boom 17. Particularly, a single operation of a boom such as an operation of lowering a boom corresponds to that operation. In such cases, a maximum flow rate of a hydraulic fluid discharged from the boom cylinder 20 becomes relatively high. On the other hand, in a case where a delicate operation using a tip end of the bucket 19, such as a returning operation (horizontally pushing operation) or a smoothing operation, is performed, careful manipulation is required, so that a maximum flow rate of a hydraulic fluid discharged from the boom cylinder 20 is set to be lower than that in a single operation described above. For example, a combined operation in which an operation of lowering a boom and an operation of pushing an arm are performed in parallel or the like, corresponds to the above-described delicate operation. It is noted that in a horizontally pushing operation, an operation of pulling an arm is dominantly performed, so that a speed at which a boom is raised is smaller than that in the above-described single operation.

Thus, in the present embodiment, a control mode which is voluntarily activated depending on a purpose of an operation is provided. In a control mode, a flow-rate control range for each cylinder is determined in accordance with construction information. Since a returning operation or a smoothing operation is performed using a tip end of the bucket 19 as described above, construction information such as a construction surface is previously stored in the storage unit 152 (FIG. 4) of the controller 106. The hydraulic excavator 10 includes angle gauges which are provided in respective turning shafts of attachments (the boom 17, the arm 18, and the bucket 19) and are not shown in the drawings. The controller 106 can obtain information about a current attitude of each attachment from a detection result given by each of the angle gauges. Consequently, in performing a highly accurate operation such as a returning operation, a desired speed of an operation of each attachment is calculated based on the above-described construction information. Then, a desired flow rate of each cylinder is automatically controlled such that it falls within a set range of the desired speed as calculated. Additionally, in one example, it is determined whether to shift to a control mode or not, based on a current attitude or a movable speed of each attachment. When an operator starts operating a boom or a bucket slowly in performing a returning operation which requires high accuracy, the controller 106 starts a control mode. It is noted that a choice of an operation among a returning operation, a smoothing operation, and the like, may be input via the input unit 115 (FIG. 4). Also, when a control mode is not active, each attachment is driven in response to an operation performed on the operation lever 107 by an operator.

In a normal operation of the hydraulic excavator 10, a maximum controlled flow rate Q1max of a hydraulic fluid discharged from the boom cylinder 20 is determined in accordance with accuracy required to perform an operation. Additionally, the maximum controlled flow rate Q1max at the time when the hydraulic excavator 10 is used is smaller than the above-described Qmax (the formula 2).

With reference to FIG. 8A, when the maximum controlled flow rate Q1max of a hydraulic fluid discharged from the boom cylinder 20 is determined, the control range Δd of the duty ratio d varies in accordance with the opening area A of an opening of each of the low-pressure-side opening/closing device 103 and the high-pressure-side opening/closing device 104. FIG. 8A shows relationships between the duty ratio d and the flow rate Q of a hydraulic fluid in respective cases where the opening area A is equal to A1 and the opening area A is equal to A2 (<A1). In a case where the opening area A of each opening is equal to A1, the duty ratio d should be set within a range Δd1 in order to perform control such that the maximum controlled flow rate Qmax is included. On the other hand, in a case where the opening area A of each opening is equal to A2, the duty ratio d should be set within a range Δd2 in order to perform control such that the maximum controlled flow rate Qmax is included. As shown in FIG. 8A, the duty-ratio control range Δd2 allows use of a wider range of duty ratios than the duty-ratio control range Δd1.

As a result, as shown in FIG. 8B, resolution (flow-rate control resolving width ΔQ) for controlling the duty ratio d varies in accordance with the opening area A. Here, the flow-rate control resolving width ΔQ is calculated by a formula 5.

[Formula 5]

$$\Delta Q1 = \frac{Q1\max}{\Delta d1 \times N} \tag{5}$$

It is noted that Δd1 in FIG. 8A is substituted in the formula 5 as one example of the duty-ratio control range Δd. As a result, the flow-rate control resolving width ΔQ is shown as ΔQ1. Here, N represents control resolution, and is a value which depends on specifications of hardware of the controller 106 (generally referred to as the number of registers). For example, in a case where the controller 106 performs control in eight bits, N is equal to 256.

With reference to FIGS. 8A and 8B, the larger the opening area A of each of the low-pressure-side opening/closing device 103 and the high-pressure-side opening/closing device 104 is, the narrower the duty-ratio control range Δd becomes. As is appreciated from the formula 5, the flow-rate control resolving width ΔQ increases as the duty-ratio control range Δd becomes narrower, so that flow-rate control resolution is lowered. Thus, in a case where the maximum controlled flow rate Q1max of the boom cylinder 20 is determined in a control mode, it is preferable that the opening area A of each of the low-pressure-side opening/closing device 103 and the high-pressure-side opening/closing device 104 is set such that the duty-ratio control range Δd is set to the largest possible range. In this case, the flow-rate control resolving width ΔQ is reduced, so that flow-rate control resolution can be improved. Then, improvement of flow-rate control resolution leads to improvement of delicate operability in the hydraulic excavator 10, particularly. As shown in FIG. 8B, when the opening area A of each of the low-pressure-side opening/closing device 103 and the high-pressure-side opening/closing device 104 is set to A2, a duty-ratio control range is equal to Δd2 (>Δd1) and a flow-rate control resolving width is equal to ΔQ2 (<ΔQ1), so that flow-rate control resolution is improved as compared to a case where the opening area A of each of the low-pressure-side opening/closing device 103 and the high-pressure-side opening/closing device 104 is set to A1.

Figure 9:
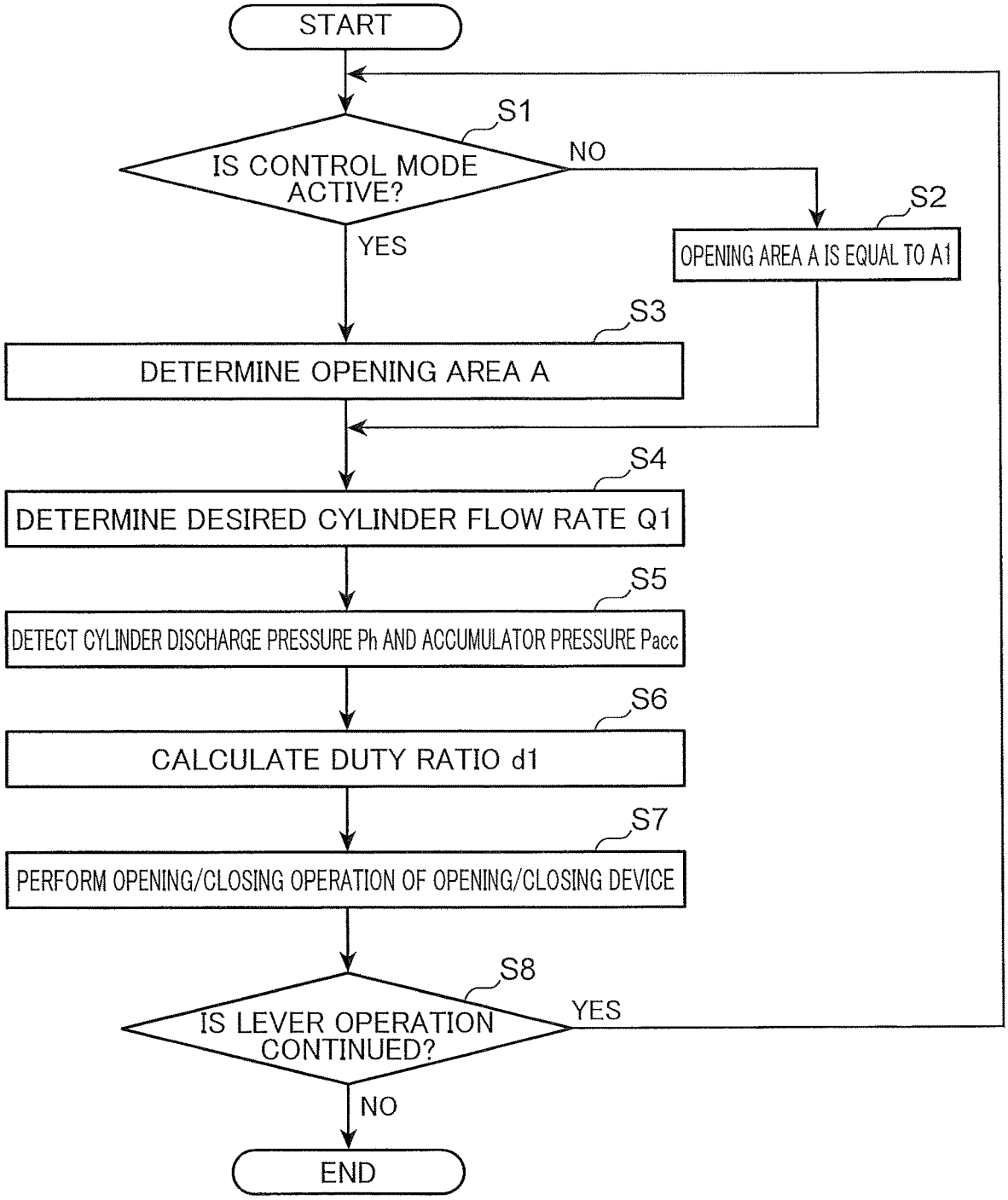
FIG. 9 is a flowchart showing a regenerating process performed by the energy regeneration device according to the one embodiment of the present invention.

FIG. 9 is a flowchart showing operations for a regenerating process performed by the regeneration device 100 according to the present embodiment. It is noted that in the present embodiment, the controller 106 performs operations for a regenerating process when an operator lowers the boom 17, in other words, the piston 202 moves downward and a volume of the head-side hydraulic chamber 203 is reduced in FIG. 3.

While the hydraulic excavator 10 is used, first, the opening-area determination unit 154 of the controller 106 checks whether or not a control mode is active (step S1 in FIG. 9). The control mode is a mode in which a desired flow rate of each cylinder is automatically controlled such that a desired speed of each attachment, the desired speed being calculated in accordance with construction information as described above, is achieved. Then, if a control mode is not active (NO in step S1), the opening-area determination unit 154 sets the opening area A of an opening of each of the low-pressure-side opening/closing device 103 and the high-pressure-side opening/closing device 104 to A1 which is previously set (refer to FIGS. 8A and 8B) (step S2). On the other hand, if a control mode is active (YES in step S1), the opening-area determination unit 154 determines the opening area A of an opening of each of the low-pressure-side opening/closing device 103 and the high-pressure-side opening/closing device 104 in accordance with a flow-rate control range of a hydraulic fluid (step S3). Here, as shown in FIG. 8A, in a case where a maximum flow rate of a hydraulic fluid discharged from the boom cylinder 20 is equal to Q1max and a flow-rate control range of a hydraulic fluid is between 0 and Q1max, the opening-area determination unit 154 sets the opening area A to A2 (A2<A1) in order to improve flow-rate control resolution.

Subsequently, when an operator of the hydraulic excavator 10 operates to lower the boom 17, the controller 106 determines the desired cylinder flow rate Q1 (a flow rate of discharged hydraulic fluid) in accordance with an operation amount of the operation lever 107 (step S4 in FIG. 9). Here, the desired cylinder flow rate Q1 (a flow rate of discharged hydraulic fluid) is determined based on the information (relational formula) of FIG. 7 stored in the storage unit 152.

Subsequently, the controller 106 controls the first pressure gauge 111 and the second pressure gauge 112, so that the cylinder discharge pressure Ph and the accumulator pressure Pacc are respectively detected (step S5 in FIG. 9).

Further, the calculation unit 151 of the controller 106 calculates the duty ratio d for controlling an opening/closing operation of each of the low-pressure-side opening/closing device 103 and the high-pressure-side opening/closing device 104 from the opening area A of an opening of each of the low-pressure-side opening/closing device 103 and the high-pressure-side opening/closing device 104, the opening area A being determined by the opening-area determination unit 154, in addition to the desired cylinder flow rate Q1 determined in step S4, the cylinder discharge pressure Ph and the accumulator pressure Pacc which are detected in step S5, using a formula 6 (step S6 in FIG. 9). It is noted that in the formula 6, the duty ratio d1 for controlling an opening/closing operation of the high-pressure-side opening/closing device 104 is calculated. As described above, the duty ratio for controlling an opening/closing operation of the low-pressure-side opening/closing device 103 is equal to 1−d1.

[Formula 6]

$$d1 = \frac{Ph - \left(\frac{Q1}{Cv \times A}\right)^2}{Pacc} \quad (6)$$

It is noted that also in the formula 6, Cv represents a flow coefficient (constant) of a valve forming each of the low-pressure-side opening/closing device 103 and the high-pressure-side opening/closing device 104. Also, A represents an opening area of an opening of each of the low-pressure-side opening/closing device 103 and the high-pressure-side opening/closing device 104, the opening area being determined by the opening-area determination unit 154.

Subsequently, the controller 106 controls an opening/closing operation of the high-pressure-side opening/closing device and an opening/closing operation of the low-pressure-side opening/closing device alternately in accordance with the duty ratio d1 which is calculated in the above-described manner (step S7 in FIG. 9).

Thereafter, if an operator continues to operate the operation lever 107 (YES in step S8), the controller 106 repeats operations for the regenerating process from step S1. On the other hand, if an operation of the operation lever 107 is finished (NO in step S8), the controller 106 finishes operations for the regenerating process.

As described above, in the present embodiment, the calculation unit 151 of the controller 106 calculates a duty ratio for controlling an open time of an opening of each of the low-pressure-side opening/closing device 103 and the high-pressure-side opening/closing device 104 in a predetermined period for a case where the piston 202 of the boom cylinder 20 moves at a predetermined moving speed in such a direction as to reduce a volume of the head-side hydraulic chamber 203. At that time, the calculation unit 151 calculates the above-described duty ratio (d1) based on the opening area A of an opening of each of the low-pressure-side opening/closing device 103 and the high-pressure-side opening/closing device 104, the opening area A being determined by the opening-area determination unit 154, the desired flow rate Q1 of a hydraulic fluid, the desired flow rate being set in accordance with the moving speed of the piston 202, the discharge pressure Ph detected by the first pressure gauge 111, and the high-pressure-side pressure Pacc (accumulator pressure) detected by the second pressure gauge 112. Then, the regeneration control unit 153 of the controller 106 controls an opening/closing operation of the low-pressure-side opening/closing device 103 and the high-pressure-side opening/closing device 104 in accordance with the above-described duty ratio (d1) in such a manner that the oil tank 110 and the accumulator 105 are alternately selected as a destination with which the inertial fluid container 102 communicates. As a result, the regeneration control unit 153 causes a hydraulic fluid to flow into the accumulator 105 due to an inertial force which is generated in an internal space of the inertial fluid container 102 when the hydraulic fluid flows toward the oil tank 110, while causing the piston 202 to move at a desired moving speed. By the above-described process, energy of a hydraulic fluid discharged from the boom cylinder 20 can be recovered in the accumulator 105, and also, a discharge flow rate of the boom cylinder 20 can be controlled. Accordingly, in a work machine such as the hydraulic excavator 10, it is possible to control an operation speed of the boom cylinder 20 in accordance with an amount of an operation performed on the operation lever 107 by an operator. Therefore, operability of an operation lever for an operator is prevented from being degraded due to recovery of energy of a hydraulic fluid. Also, even in a case where the discharge pressure Ph of the boom cylinder 20 is higher than the accumulator pressure Pacc of the accumulator 105, energy of a hydraulic fluid discharged from the boom cylinder 20 can be recovered in the accumulator 105 by the above-described control of regeneration.

Further, in the present embodiment, the opening-area determination unit 154 determines the opening area A before the calculation unit 151 calculates a duty ratio for controlling the low-pressure-side opening/closing device 103 and the high-pressure-side opening/closing device 104. The opening area A is set depending on whether or not a control mode is activated by the drive control unit 150. That is, in a case where high accuracy is required in controlling an attitude of the boom 17, such as a case where a delicate operation is performed, a flow rate of a hydraulic fluid discharged from the boom cylinder 20 is controlled with high resolution (refer to a graph for a case of A=A2 in FIG. 8B). On the other hand, in a case where a normal operation is performed by an operation of an operator, relatively high resolution is not required. For this reason, a flow rate of a hydraulic fluid discharged from the boom cylinder 20 is controlled with lower resolution than that in the above-described case (refer to a graph for a case of A=A1 in FIG. 8B). In this manner, as compared to a case where the opening areas A of the low-pressure-side opening/closing device 103 and the high-pressure-side opening/closing device 104 are fixed, resolution for control of a flow rate of a hydraulic fluid discharged from the boom cylinder 20 can be improved in the present embodiment.

Also, in the present embodiment, the opening areas A (A1) of the low-pressure-side opening/closing device 103 and the high-pressure-side opening/closing device 104 are set to be identical to each other. In this case, an area of a section of an opening is not changed when a destination of flow of a working fluid, the destination communicating with the inertial fluid container 102, is switched between the low-pressure-side opening/closing device 103 and the high-pressure-side opening/closing device 104, and thus flow of a hydraulic fluid can be stably maintained.

Hereinabove, the regeneration device 100 according to the embodiment of the present invention and the hydraulic excavator 10 including the foregoing device have been described. With the above-described hydraulic excavator 10, it is possible to regenerate energy of a hydraulic fluid discharged from the boom cylinder 20 while controlling a flow rate of the hydraulic fluid in accordance with an amount of an operation performed on the operation lever 107 by an operator. Also, accuracy (resolution) for control of a duty ratio can be adjusted in accordance with operational conditions of an actuator such as the boom cylinder 20.

It should be noted that the present invention is not limited to the above-described embodiment. As a work machine according to the present invention, the following modified embodiments are possible.

Figure 10:
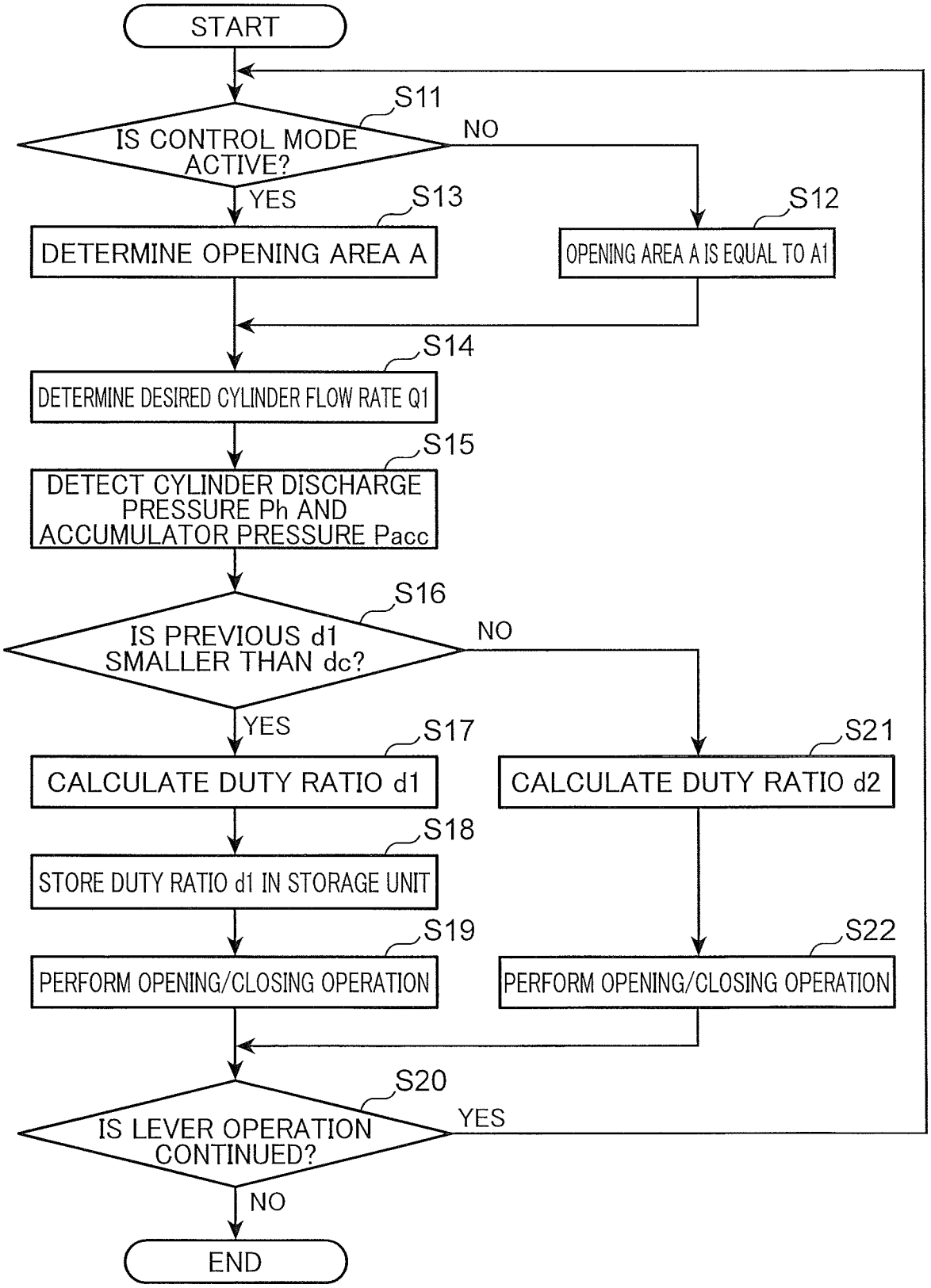
FIG. 10 is a flowchart showing a regenerating process performed by an energy regeneration device according to a modified embodiment of the present invention.

(1) Though it has been described in the above-described embodiment that when the calculation unit 151 (FIG. 4) calculates the duty ratio d1 in step S6 in FIG. 9, the regeneration control unit 153 (FIG. 4) sets a duty ratio for each of the low-pressure-side opening/closing device 103 and the high-pressure-side opening/closing device 104 based on the above-described d1 (step S7 in FIG. 9), the present invention is not limited thereto. FIG. 10 is a flowchart showing a regenerating process performed by the regeneration device 100 (energy regeneration device) according to a modified embodiment of the present invention. In the present modified embodiment, differences from the foregoing embodiment will be described and description of similar points will be omitted.

Features of the present modified embodiment lie in inclusion of a function of preventing backflow of a hydraulic fluid from the accumulator 105 to the inertial fluid container 102 before it occurs. As shown in FIG. 6, as the duty ratio d (d1) for controlling an open time of the high-pressure-side opening/closing device 104 becomes closer to one, the regeneration rate η decreases. Further, in FIG. 6, when a duty ratio is set to be equal to or higher than dc (the flow rate Q is equal to or lower than Qc), the regeneration rate η becomes equal to zero, so that backflow from the accumulator 105 (FIG. 3) to the boom cylinder 20 occurs. In the present modified embodiment, a regeneratable limit duty ratio dc (threshold value) which is a limit below (condition under) which such backflow will not occur is previously obtained by experiments or analysis, and is stored in the storage unit 152 (FIG. 4).

In FIG. 10, steps S11 to S15 correspond to steps S1 to S5 in FIG. 9. Then, in the present embodiment, in step S16, the regeneration control unit 153 determines whether or not the duty ratio d1 which is previously calculated by the calculation unit 151 and is stored in the storage unit 152 is lower than the regeneratable limit duty ratio dc (step S16). Here, if the duty ratio d1 stored in the storage unit 152 is lower than the regeneratable limit duty ratio dc (YES in step S16), the calculation unit 151 newly calculates the duty ratio d1 for the low-pressure-side opening/closing device 103 and the high-pressure-side opening/closing device 104 in the same manner as in the foregoing embodiment (step S17 in FIG. 10). Thereafter, the regeneration control unit 153 stores the duty ratio d1 which is calculated, in the storage unit 152. Additionally, in a case where the hydraulic excavator 10 is used for the first time, an initial value of the duty ratio d1 is previously stored in the storage unit 152. Thus, in step S18, the duty ratio d1 as calculated is stored so that the initial value is updated. Thereafter, the regeneration control unit 153 performs an opening/closing operation of the low-pressure-side opening/closing device 103 and the high-pressure-side opening/closing device 104 in the same manner as in the foregoing embodiment (steps S19 and S20).

On the other hand, in step S16, if the duty ratio d1 stored in the storage unit 152 is equal to or higher than the regeneratable limit duty ratio dc (NO in step S16), the calculation unit 151 firstly calculates an anti-backflow duty ratio d2 based on the following formula 7 (step S21). The anti-backflow duty ratio d2 is set such that the desired flow rate Q1 of a hydraulic fluid is maintained even when only the low-pressure-side opening/closing device 103 is opened. Additionally, in another modified embodiment, the anti-backflow duty ratio d2 may be previously calculated and stored in the storage unit 152. As described above, Cv represents a flow coefficient (constant) of the low-pressure-side opening/closing device 103, A represents an opening area of an opening of the low-pressure-side opening/closing device 103, and Ph represents a discharge pressure detected by the first pressure gauge 111.

[Formula 7]

$$d2 = \frac{Q1}{(Cv \times A \times \sqrt{Ph})} \tag{7}$$

Then, the regeneration control unit 153 closes an opening of the high-pressure-side opening/closing device 104 and opens or closes the low-pressure-side opening/closing device 103 depending on the anti-backflow duty ratio d2 which is calculated (step S22 in FIG. 10). As a result, without regeneration of a hydraulic fluid, a hydraulic fluid is discharged into the oil tank 110 while being maintained at the desired flow rate Q1. Thereafter, operations for the regenerating process are repeated depending on an operation state of the operation lever 107 in the same manner as in the foregoing embodiment (step S20).

As described above, according to the present modified embodiment, in a region where a hydraulic fluid can be regenerated (refer to a regeneratable region in FIG. 6), energy of the boom cylinder 20 can be regenerated for the accumulator 105. On the other hand, under conditions where it is difficult to regenerate a hydraulic fluid (refer to a backflow region in FIG. 6), backflow from the accumulator 105 to the boom cylinder 20 can be prevented. As a consequence, useless outflow of energy of pressure oil accumulated in the accumulator 105 is suppressed, so that an effect of stable energy regeneration can be achieved. It is noted that alternatively, a regeneratable limit flow rate Qc shown in FIG. 6 which is previously obtained by experiments or analysis may be stored in the storage unit 152 (FIG. 4), in place of the above-described regeneratable limit duty ratio dc (threshold value). Also, in order to reliably prevent backflow of a hydraulic fluid from the accumulator 105 toward the boom cylinder 20, a check valve not shown in the drawings may be provided upstream or downstream of the high-pressure-side opening/closing device 104. Additionally, in the present modified embodiment, an opening area of an opening of the low-pressure-side opening/closing device 103 in a case where a hydraulic fluid is regenerated for the accumulator 105 (step S19 in FIG. 10) is the same as that in a case where a hydraulic fluid is not regenerated and discharged to the oil tank 110. Accordingly, a speed of flow of a hydraulic fluid is prevented from abruptly changing due to a change in an area of an opening of the low-pressure-side opening/closing device 103.

(2) Also, though it has been described in each of the above-described embodiments that the first pressure gauge 111 (FIG. 3) actually measures and obtains Ph (discharge pressure), the present invention is not limited thereto. A value of Ph (Ph0) may be estimated by the above-described formula 3, and an estimated value which is obtained may be used for calculation based on the formula 5.

(3) Also, though it has been described in the above-described embodiments that opening areas A of the low-pressure-side opening/closing device 103 and the high-pressure-side opening/closing device 104 are set to be identical to each other, the present invention is not limited to those embodiments. In step S6 in FIG. 9, the calculation unit 151 can calculate the duty ratio d1 using the following formulas 8, 9 and 10 in place of the above-described formula 6.

[Formula 8]

$$Q1h=d1\times Cv\times Ah\times\sqrt{(Ph-d1\times Pacc)} \quad (8)$$

[Formula 9]

$$Q1r=(1-d1)\times Cv\times Ar\times\sqrt{(Ph-d1\times Pacc)} \quad (9)$$

[Formula 10]

$$Q1=Q1h+Q1r \quad (10)$$

In the formula 8, Ah represents an opening area of the high-pressure-side opening/closing device 104, and Ar in the formula 9 represents an opening area of the low-pressure-side opening/closing device 103. Also, in the formula 10, Q1 represents a desired flow rate of a hydraulic fluid discharged from the boom cylinder 20, Q1*h* represents a flow rate of a part of the hydraulic fluid flowing at the rate Q1, the part passing through the high-pressure-side opening/closing device 104, and Q1*r* represents a flow rate of a part of the hydraulic fluid flowing at the rate Q1, the part passing through the low-pressure-side opening/closing device 103. The other constants and variables are the same as those in the above-described embodiments. In this case, the calculation unit 151 calculates a value of d1 which satisfies the formulas 8 to 10 by numerical analysis or the like. To this end, a relationship between the duty ratio d1 and the desired flow rate Q1 of a hydraulic fluid may be stored as information in a map or table form in the calculation unit 151, to be used for later control. In this manner, according to the present modified embodiment, even in a case where the opening areas Ah and Ar of respective openings of the high-pressure-side opening/closing device 104 and the low-pressure-side opening/closing device 103 are set to be different from each other, energy of the boom cylinder 20 can be regenerated for the accumulator 105.

(4) Also, though the accumulator 105 has been described as a high-pressure-side container of the present invention in the above-described embodiments, the present invention is not limited to those embodiments. For a high-pressure-side container, a configuration in which a known regeneration motor is provided and the regeneration motor is driven to rotate by energy of a working fluid flowing out of the inertial fluid container 102, may be provided. Alternatively, a configuration in which the arm cylinder 22 in FIG. 1 functions as a high-pressure-side container and a hydraulic fluid (working fluid) flowing out of the inertial fluid container 102 is supplied to the arm cylinder 22, may be provided. In this case, a hydraulic fluid being supplied facilitates an operation of pushing an arm.

(5) Also, though it has been described in the above-described embodiments that the opening-area determination unit 154 determines the opening area A of each of the low-pressure-side opening/closing device 103 and the high-pressure-side opening/closing device 104, depending on whether or not a control mode of the hydraulic excavator 10 is active, the present invention is not limited thereto. The opening-area determination unit 154 may be configured so as to determine A1 (first area) in FIGS. 8A and 8B as the opening area A in a case where operational conditions of the hydraulic excavator 10 require a first flow rate as a maximum flow rate of a hydraulic fluid discharged from the head-side hydraulic chamber 203 of the boom cylinder 20, while determining A2 (A2<A1) (second area) in FIG. 8 as the opening area A in a case where operational conditions of the hydraulic excavator 10 require a second flow rate lower than the first flow rate as the maximum flow rate of the hydraulic fluid. In this case, like a case where a combined operation is performed with the operation lever 107, under operational conditions where a maximum flow rate of a hydraulic fluid is low, accuracy of control of a duty ratio is set to be high. Accordingly, it is possible to recover energy of a hydraulic fluid discharged from the boom cylinder 20 in the accumulator 105 while driving the boom 17 connected to the boom cylinder 20 with high accuracy.

Also, in another modified embodiment, the opening-area determination unit 154 may be configured so as to determine A1 (the first area) in FIGS. 8A and 8B as the opening area A in a case where operational conditions of the hydraulic excavator 10 require first accuracy in controlling a position of the boom 17, while determining A2 (A2<A1) (the second area) in FIGS. 8A and 8B as the opening area A in a case where operational conditions of the hydraulic excavator 10 require second accuracy higher than the first accuracy in controlling a position of the boom 17. In this case, under operational conditions where high accuracy is required in controlling a position of the boom 17, accuracy of control of a duty ratio is set to be high. Accordingly, it is possible to recover energy of a hydraulic fluid discharged from the boom cylinder 20 in the accumulator 105 while driving the boom 17 connected to the boom cylinder 20 with high accuracy.

As described above, the present invention provides an energy regeneration device for regenerating energy of a working fluid, including: an actuator including a cylinder and a piston that is reciprocatable in the cylinder, the actuator being configured such that a volume of a cylinder fluid chamber defined by the cylinder and the piston varies along with movement of the piston; an inertial fluid container including a first internal space that is configured to communicate with the cylinder fluid chamber, the inertial fluid container being configured to receive the working fluid that is discharged from the cylinder fluid chamber due to the movement of the piston; a low-pressure-side container including a second internal space that is set at a pressure lower than that of the cylinder fluid chamber and is configured to communicate with the first internal space of the inertial fluid container, the low-pressure-side container being configured to receive the working fluid flowing out of the inertial fluid container; a high-pressure-side container including a third internal space that is set at a pressure higher than that of the second internal space of the low-pressure-side container and is configured to communicate with the first internal space of the inertial fluid container, the high-pressure-side container being configured to receive the working fluid flowing out of the inertial fluid container; a low-pressure-side opening/closing device forming a low-pressure-side opening that is configured to permit flowing of the working fluid between the inertial fluid container and the low-pressure-side container, the low-pressure-side opening/closing device being configured to operate to change an opening area of the low-pressure-side opening; a high-pressure-side opening/closing device forming a high-pressure-side opening that is configured to permit flowing of the working fluid between the high-pressure-side container and the inertial fluid container, the high-pressure-side opening/closing device being configured to operate to change an opening area of the high-pressure-side opening; a first pressure obtaining unit configured to obtain a discharge pressure of the working fluid upstream of the inertial fluid container in flow of the working fluid flowing out of the cylinder fluid chamber; a second pressure obtaining unit configured to obtain a high-pressure-side pressure of the working fluid downstream of the high-pressure-side opening/closing device in the flow of the working fluid flowing out of the cylinder fluid chamber; an opening-area determination unit configured to determine the opening area of each of the high-pressure-side opening and the low-pressure-side opening in accordance with operational conditions of the actuator; a calculation unit configured to calculate a duty ratio for controlling an open time of each of the low-pressure-side opening and the high-pressure-side opening in a predetermined period for a case where the piston moves at a predetermined moving speed in such a direction as to reduce the volume of the cylinder fluid chamber, the calculation unit being configured to calculate the duty ratio based on the opening area of each of the high-pressure-side opening and the low-pressure-side opening, the opening area being determined by the opening-area determination unit, a desired flow rate of the working fluid discharged from the cylinder fluid chamber, the desired flow rate being set in accordance with the moving speed of the piston, the discharge pressure obtained by the first pressure obtaining unit, and the high-pressure-side pressure obtained by the second pressure obtaining unit; and an opening/closing-device control unit configured to control an opening/closing operation of the high-pressure-side opening/closing device and the low-pressure-side opening/closing device in accordance with the duty ratio such that the low-pressure-side container and the high-pressure-side container are alternately selected as a destination with which the inertial fluid container communicates, to cause the working fluid to flow into the high-pressure-side container due to an inertial force that is generated in the first internal space of the inertial fluid container when the working fluid flows toward the low-pressure-side container, while causing the piston to move at the moving speed.

With this configuration, the opening/closing-device control unit controls an opening/closing operation of the high-pressure-side opening/closing device and the low-pressure-side opening/closing device in accordance with the duty ratio calculated by the calculation unit. As a result, energy of the working fluid discharged from the actuator can be recovered in the high-pressure-side container, and a discharge flow rate of the actuator can be controlled. Also, the opening-area determination unit determines an opening area of each of the high-pressure-side opening and the low-pressure-side opening in accordance with operational conditions of the actuator. Accordingly, accuracy (resolution) in controlling a duty ratio can be adjusted in accordance with the operational conditions of the actuator.

In the above-described configuration, the calculation unit calculates a high-pressure-side duty ratio d1 for controlling the open time of the high-pressure-side opening in the period based on a relational formula of $d1=(Ph-(Q1/(Cv\times A))^2)/Pacc$ in which A represents the opening area of each of the high-pressure-side opening and the low-pressure-side opening, Ph represents the discharge pressure of the working fluid, the discharge pressure being obtained by the first pressure obtaining unit, Pacc represents the high-pressure-side pressure of the working fluid, the high-pressure-side pressure being obtained by the second pressure obtaining unit, Q1 represents the desired flow rate of the working fluid, d1 represents the high-pressure-side duty ratio, 1−d1 represents a low-pressure-side duty ratio for controlling the open time of the low-pressure-side opening in the period, and Cv represents a constant that is previously set for the high-pressure-side opening/closing device and the low-pressure-side opening/closing device.

With this configuration, the opening areas of the high-pressure-side opening and the low-pressure-side opening are set to identical values and a destination of flow of the working fluid is switched between the high-pressure-side container and the low-pressure-side container, so that flow of the working fluid discharged from the actuator can be stably maintained. Also, by switching a destination of flow of the working fluid between the high-pressure-side container and the low-pressure-side container at a high speed, it is possible to stably maintain flow of the working fluid discharged from the actuator.

In the above-described configuration, it is preferable that further included is a storage unit in which a threshold value that is previously set for the high-pressure-side duty ratio is stored, and when the high-pressure-side duty ratio calculated by the calculation unit is equal to or higher than the threshold value, the opening/closing-device control unit closes the high-pressure-side opening of the high-pressure-side opening/closing device and opens/closes the low-pressure-side opening depending on an anti-backflow duty ratio that is set in accordance with the desired flow rate of the working fluid.

With this configuration, backflow of the working fluid from the high-pressure-side container toward the actuator can be prevented.

In the above-described configuration, it is preferable that when the high-pressure-side duty ratio calculated by the calculation unit is equal to or higher than the threshold value, the calculation unit calculates the anti-backflow duty ratio based on a relational formula of $d2=Q1/(Cv\times A\times\sqrt{(Ph)})$, and the opening/closing-device control unit opens/closes the low-pressure-side opening depending on the anti-backflow duty ratio that is calculated.

With this configuration, backflow of the working fluid from the high-pressure-side container toward the actuator can be prevented. Also, even after the high-pressure-side opening is closed in order to prevent backflow, it is possible to allow the working fluid to flow into the low-pressure-side container while controlling a discharge flow rate of the actuator.

In the above-described configuration, it is preferable that the high-pressure-side container is an accumulator in which a pressure of the working fluid is accumulated.

With this configuration, after energy of the working fluid discharged from the actuator is accumulated in the accumulator, the energy can be utilized for the other purposes.

Also provided is a work machine including: an engine; the energy regeneration device according to any one of the above; a driven object connected to the piston of the actuator of the energy regeneration device; a pump being configured to be driven by the engine and discharge the working fluid supplied to the cylinder fluid chamber of the actuator; a control valve placed between the pump and the actuator on a path of the working fluid, the control valve being configured to control a flow rate of the working fluid supplied to the cylinder fluid chamber, to drive the actuator; an operation lever configured to receive an operation for an instruction to drive the driven object; and a drive control unit configured to control movement of the actuator by operating the control valve in accordance with an amount of an operation performed on the operation lever, wherein the desired flow rate of the working fluid discharged from the cylinder fluid chamber is set in accordance with the amount of the operation performed on the operation lever.

With this configuration, it is possible to regenerate energy of the working fluid discharged from the actuator while controlling a flow rate of the working fluid in accordance with an amount of an operation performed on the operation lever by an operator.

In the above-described configuration, it is preferable that the opening-area determination unit determines a first area as the opening area in a case where the operational conditions of the actuator require first accuracy in controlling a position of the driven object, and that the opening-area determination unit determines a second area smaller than the first area as the opening area in a case where the operational conditions of the actuator require second accuracy higher than the first accuracy in controlling the position of the driven object.

With this configuration, under the operational conditions which require high accuracy in controlling a position of the driven object, accuracy in controlling a duty ratio is set to be high. Accordingly, it is possible to recover energy of a working fluid discharged from the actuator in the high-pressure-side container while driving the driven object connected to the actuator with high accuracy.

In the above-described configuration, it is preferable that the opening-area determination unit determines a first area as the opening area in a case where the operational conditions of the actuator for driving the driven object require a first flow rate as a maximum flow rate of the working fluid discharged from the cylinder fluid chamber, and that the opening-area determination unit determines a second area smaller than the first area as the opening area in a case where the operational conditions of the actuator require a second flow rate smaller than the first flow rate as the maximum flow rate of the working fluid discharged from the cylinder fluid chamber.

With this configuration, under the operational conditions where a maximum flow rate of a working fluid is low, accuracy in controlling a duty ratio is set to be high. Accordingly, it is possible to recover energy of a working fluid discharged from the actuator in the high-pressure-side container while driving the driven object connected to the actuator with high accuracy.

The invention claimed is:

1. An energy regeneration device for regenerating energy of a working fluid, comprising:

an actuator including a cylinder and a piston that is reciprocatable in the cylinder, the actuator being configured such that a volume of a cylinder fluid chamber defined by the cylinder and the piston varies along with movement of the piston;

an inertial fluid container including a first internal space that is configured to communicate with the cylinder fluid chamber, the inertial fluid container being configured to receive the working fluid that is discharged from the cylinder fluid chamber due to the movement of the piston;

a low-pressure-side container including a second internal space that is set at a pressure lower than that of the cylinder fluid chamber and is configured to communicate with the first internal space of the inertial fluid container, the low-pressure-side container being configured to receive the working fluid flowing out of the inertial fluid container;

a high-pressure-side container including a third internal space that is set at a pressure higher than that of the second internal space of the low-pressure-side container and is configured to communicate with the first internal space of the inertial fluid container, the high-pressure-side container being configured to receive the working fluid flowing out of the inertial fluid container;

a low-pressure-side opening/closing device forming a low-pressure-side opening that is configured to permit flowing of the working fluid between the inertial fluid container and the low-pressure-side container, the low-pressure-side opening/closing device being configured to operate to change an opening area of the low-pressure-side opening;

a high-pressure-side opening/closing device forming a high-pressure-side opening that is configured to permit flowing of the working fluid between the high-pressure-side container and the inertial fluid container, the high-pressure-side opening/closing device being configured to operate to change an opening area of the high-pressure-side opening;

a first pressure obtaining unit configured to obtain a discharge pressure of the working fluid upstream of the inertial fluid container in the flow of the working fluid flowing out of the cylinder fluid chamber;

a second pressure obtaining unit configured to obtain a high-pressure-side pressure of the working fluid downstream of the high-pressure-side opening/closing device in the flow of the working fluid flowing out of the cylinder fluid chamber;

an opening-area determination unit configured to determine the opening area of each of the high-pressure-side opening and the low-pressure-side opening in accordance with operational conditions of the actuator;

a calculation unit configured to calculate a duty ratio for controlling an open time of each of the low-pressure-side opening and the high-pressure-side opening in a predetermined period for a case where the piston moves at a predetermined moving speed in such a direction as to reduce the volume of the cylinder fluid chamber, the calculation unit being configured to calculate the duty ratio based on the opening area of each of the high-pressure-side opening and the low-pressure-side opening, the opening area being determined by the opening-area determination unit, a desired flow rate of the working fluid discharged from the cylinder fluid chamber, the desired flow rate being set in accordance with the moving speed of the piston, the discharge pressure obtained by the first pressure obtaining unit, and the high-pressure-side pressure obtained by the second pressure obtaining unit; and an opening/closing-device control unit configured to control an opening/closing operation of the high-pressure-side opening/closing device and the low-pressure-side opening/closing device in accordance with the duty ratio such that the low-pressure-side container and the high-pressure-side container are alternately selected as a destination with which the inertial fluid container communicates, to cause the working fluid to flow into the high-pressure-side container due to an inertial force that is generated in the first internal space of the inertial fluid container when the working fluid flows toward the low-pressure-side container, while causing the piston to move at the moving speed.

2. The energy regeneration device according to claim 1, wherein the calculation unit calculates a high-pressure-side duty ratio d1 for controlling the open time of the high-pressure-side opening in the period based on a relational formula of $d1=(Ph-(Q1/(Cv\times A))^2)/Pacc$ in which A represents the opening area of each of the high-pressure-side opening and the low-pressure-side opening, Ph represents the discharge pressure of the working fluid, the discharge pressure being obtained by the first pressure obtaining unit, Pacc represents the high-pressure-side pressure of the working fluid, the high-pressure-side pressure being obtained by the second pressure obtaining unit, Q1 represents the desired flow rate of the working fluid, d1 represents the high-pressure-side duty ratio, 1−d1 represents a low-pressure-side duty ratio for controlling the open time of the low-pressure-side opening in the period, and Cv represents a constant that is previously set for the high-pressure-side opening/closing device and the low-pressure-side opening/closing device.

3. The energy regeneration device according to claim 2, further comprising a memory in which a threshold value that is previously set for the high-pressure-side duty ratio is stored, wherein when the high-pressure-side duty ratio calculated by the calculation unit is equal to or higher than the threshold value, the opening/closing-device control unit closes the high-pressure-side opening of the high-pressure-side opening/closing device and opens/closes the low-pressure-side opening depending on an anti-backflow duty ratio that is set in accordance with the desired flow rate of the working fluid.

4. The energy regeneration device according to claim 3, wherein when the high-pressure-side duty ratio calculated by the calculation unit is equal to or higher than the threshold value, the calculation unit calculates the anti-backflow duty ratio d2 based on a relational formula of $d2=Q1/(Cv\times A\times\sqrt{(Ph)})$, and the opening/closing-device control unit opens/closes the low-pressure-side opening depending on the anti-backflow duty ratio that is calculated.

5. The energy regeneration device according to claim 1, wherein the high-pressure-side container is an accumulator in which a pressure of the working fluid is accumulated.

6. A work machine comprising:

an engine;

the energy regeneration device according to claim 1;

a driven object connected to the piston of the actuator of the energy regeneration device;

a pump being configured to be driven by the engine and configured to discharge the working fluid supplied to the cylinder fluid chamber of the actuator;

a control valve placed between the pump and the actuator on a path of the working fluid, the control valve being configured to control a flow rate of the working fluid supplied to the cylinder fluid chamber, to drive the actuator;

an operation lever configured to receive an operation for an instruction to drive the driven object; and a drive control unit configured to control movement of the actuator by operating the control valve in accordance with an amount of an operation performed on the operation lever, wherein the desired flow rate of the working fluid discharged from the cylinder fluid chamber is set in accordance with the amount of the operation performed on the operation lever.

7. The work machine according to claim 6, wherein the opening-area determination unit determines a first area as the opening area in a case where the operational conditions of the actuator require a first accuracy in controlling a position of the driven object, and the opening-area determination unit determines a second area smaller than the first area as the opening area in a case where the operational conditions of the actuator require a second accuracy higher than the first accuracy in controlling the position of the driven object.

8. The work machine according to claim 6, wherein the opening-area determination unit determines a first area as the opening area in a case where the operational conditions of the actuator require a first flow rate as a maximum flow rate of the working fluid discharged from the cylinder fluid chamber, and the opening-area determination unit determines a second area smaller than the first area as the opening area in a case where the operational conditions of the actuator require a second flow rate smaller than the first flow rate as the maximum flow rate of the working fluid discharged from the cylinder fluid chamber.

* * * * *